US010217404B2

(12) United States Patent
Kawada et al.

(10) Patent No.: US 10,217,404 B2
(45) Date of Patent: Feb. 26, 2019

(54) DISPLAY PANEL, DISPLAY DEVICE AND ELECTRONIC APPARATUS

(71) Applicant: JOLED Inc., Tokyo (JP)

(72) Inventors: Hitoshi Kawada, Tokyo (JP); Naobumi Toyomura, Kanagawa (JP)

(73) Assignee: JOLED Inc., Tokyo (JP)

( * ) Notice: Subject to any disclaimer, the term of this patent is extended or adjusted under 35 U.S.C. 154(b) by 532 days.

(21) Appl. No.: 13/955,625

(22) Filed: Jul. 31, 2013

(65) Prior Publication Data

US 2014/0035798 A1 Feb. 6, 2014

(30) Foreign Application Priority Data

Aug. 6, 2012 (JP) ..... 2012-174278

(51) Int. Cl.

| | |
|---|---|
| ***G09G 3/3208*** | (2016.01) |
| ***G09G 3/3233*** | (2016.01) |
| ***G09G 3/3266*** | (2016.01) |
| ***G09G 3/20*** | (2006.01) |

(52) U.S. Cl.

CPC ..... *G09G 3/3208* (2013.01); *G09G 3/2003* (2013.01); *G09G 3/3233* (2013.01); *G09G 3/3266* (2013.01); *G09G 2300/0452* (2013.01); *G09G 2300/0819* (2013.01); *G09G 2300/0842* (2013.01); *G09G 2320/043* (2013.01); *G09G 2320/0666* (2013.01)

(58) Field of Classification Search

CPC ..... G09G 3/3607; G09G 2310/067; G09G 3/3208; G09G 3/3233; G09G 3/2003; G09G 2300/0819; G09G 2300/0452; G09G 2300/043; G09G 2320/0666; G09G 3/3266

See application file for complete search history.

(56) References Cited

U.S. PATENT DOCUMENTS

| | | | | |
|---|---|---|---|---|
| 5,149,182 A * | 9/1992 | Keller | G01J 1/04 | 250/226 |
| 7,864,271 B2 * | 1/2011 | Nakamura et al. | 349/109 | |
| 7,868,861 B2 * | 1/2011 | Cho | G09G 3/3648 | 345/204 |
| 8,054,298 B2 * | 11/2011 | Asano | G09G 3/3233 | 345/173 |

(Continued)

FOREIGN PATENT DOCUMENTS

| | | |
|---|---|---|
| JP | 2008-083272 | 4/2008 |
| JP | 2009-103868 A | 5/2009 |
| JP | 2011-123184 A | 6/2011 |
| JP | 2013-195477 A | 9/2013 |

OTHER PUBLICATIONS

Japanese Office Action dated Mar. 29, 2016 for JP 2012-174278.

*Primary Examiner* — Mihir K Rayan

(74) *Attorney, Agent, or Firm* — Michael Best & Friedrich LLP

(57) ABSTRACT

A display device includes pixel circuits disposed in rows and columns. A first pixel circuit is configured to emit light of a first color, and a second pixel circuit is configured to emit light of a second color, with the first color preferably being green. A given signal line provides a first image data signal and a second image data signal respectively to the first pixel circuit and the second pixel circuit within a horizontal scanning period, with the first pixel circuit receiving the first image data signal before the second pixel circuit receives the second image data signal.

20 Claims, 25 Drawing Sheets

(56) References Cited

U.S. PATENT DOCUMENTS

| | | | | |
|---|---|---|---|---|
| 8,289,234 | B2 * | 10/2012 | Kim | G09G 3/3233 313/463 |
| 8,525,769 | B2 * | 9/2013 | Miyashita | 345/96 |
| 9,343,022 | B2 * | 5/2016 | Park | G09G 3/3607 |
| 2003/0016189 | A1 * | 1/2003 | Abe | G09G 3/20 345/55 |
| 2005/0264497 | A1 * | 12/2005 | Shin | G09G 3/3233 345/76 |
| 2006/0034125 | A1 * | 2/2006 | Kim | G09G 3/3648 365/185.22 |
| 2007/0115225 | A1 * | 5/2007 | Uchino | G09G 3/3233 345/76 |
| 2008/0079678 | A1 * | 4/2008 | Cho | G09G 3/3648 345/88 |
| 2009/0102760 | A1 | 4/2009 | Yamashita et al. | |
| 2009/0244055 | A1 * | 10/2009 | Asano | G09G 3/3233 345/214 |
| 2009/0262258 | A1 * | 10/2009 | Taneda | G09G 3/3233 348/739 |
| 2009/0278771 | A1 * | 11/2009 | Yamamoto | G09G 3/3233 345/76 |
| 2010/0110114 | A1 * | 5/2010 | Hashimoto | G09G 3/3614 345/691 |
| 2010/0156808 | A1 * | 6/2010 | Stallings | G06F 3/04886 345/173 |
| 2012/0098871 | A1 * | 4/2012 | Park et al. | 345/690 |
| 2012/0242719 | A1 * | 9/2012 | Klompenhouwer et al. | 345/690 |

* cited by examiner

FIG. 7

| | DTL(m) | DTL(m+1) | DTL(m+2) | DTL(m+3) |
|---|---|---|---|---|
| V(n) | Vsig(n, m) | Vsig(n+1, m+1) | Vsig(n, m+2) | Vsig(n+1, m+3) |
| V(n+1) | Vsig(n+1, m) | Vsig(n, m+1) | Vsig(n+1, m+2) | Vsig(n, m+3) |
| V(n+2) | Vsig(n+2, m) | Vsig(n+3, m+1) | Vsig(n+2, m+2) | Vsig(n+3, m+3) |
| V(n+3) | Vsig(n+3, m) | Vsig(n+2, m+1) | Vsig(n+3, m+2) | Vsig(n+2, m+3) |

710
720
740

710
720

710
730
770
760
750

710
720

720
710

720
730
710

710
720

DISPLAY PANEL, DISPLAY DEVICE AND ELECTRONIC APPARATUS

BACKGROUND

The present technology relates to a display panel including a light emitting element, for example, such as an organic EL (Electro Luminescence) element for each pixel, a display device including the display panel and an electronic apparatus.

In recent years, in the field of display device which performs an image display, as a light emitting element of a pixel, a display device using a current driving type light emitting element, for example, the organic EL element, in which the light emitting luminance is changed according to a flowing current value, has been developed and promoted to commercialization. The organic EL element is different from a liquid crystal element or the like and is a self-light emitting element. Therefore, since it is not necessary for a display device using the organic EL element (an organic EL display device) to have a light source (backlight), it is possible for it to be thinner and have a higher luminance than a liquid crystal display device with a light source.

Here, generally, the current-voltage (I-V) characteristics of the organic EL element are degraded (time degradation) according to time course. In a pixel circuit in which the organic EL element is driven by the current, when I-V characteristics of the organic EL element are changed according to time course, since the partial pressure ratio of the organic EL element and a driving transistor connected to the organic EL element in series is changed, a voltage between a gate and a source of the driving transistor is also changed. As a result, since the current value which flows to a driving transistor is changed, a current value which flows to the organic EL element is also changed and the light emitting luminance is also changed according to the current value.

In addition, there are cases when the threshold voltage (Vth) of the driving transistor and the mobility (μ) are changed according to time course and Vth and μ are different for each pixel circuit due to the variability in a manufacturing process. In a case where Vth and μ of the driving transistor are different for each pixel circuit, since the current value which flows to the driving transistor varies for each pixel circuit, even though the same voltage is applied to the gate of the driving transistor, the light emitting luminance of the organic EL element is varied and the uniformity of a screen is impaired.

Here, even though I-V characteristics of the organic EL element are changed according to time course and Vth and μ of the driving transistor are changed according to time course, a display device in which the compensation function with respect to the change of I-V characteristics of the organic EL element and the correction function with respect to the change of Vth and μ of the driving transistor in order to maintain the uniform light emitting luminance of the organic EL element without being affected thereby are incorporated, has been developed (for example, refer to Japanese Unexamined Patent Application Publication No. 2008-083272).

SUMMARY

Here, for example, in a driving method in the related art as shown in FIG. 11, a Vth correction in which a voltage between the gate and the source of the driving transistor is set close to the threshold voltage of the driving transistor and a signal writing in which a signal voltage according to an picture signal is written in the gate of the driving transistor are performed every 1H period. Therefore, in the driving method, it was difficult to shorten a 1H period and shorten a scanning period per 1F (that is, to set up as a high speed driving). Therefore, for example, after performing the Vth correction with two lines together within a common 1H period, the signal writing is performed for each line within next 1H period as shown in FIG. 12. The driving method is suited for a high speed driving due to the Vth correction being bundled. However, further high speed driving is desired in the future.

Here, for example, in a driving method shown in FIG. 12, it is thought that a 1H period is substantially shortened. However, in a case of doing so, for example, in a pixel in the n-th row and a pixel in the n+1-th row, the timing margin in the signal writing becomes greatly shortened. When the timing margin becomes inadequate, it is difficult to write the signal voltage of the desired value in the pixels due to transient. As a result, there were problems in which the luminance unevenness and chromaticity shift occurred.

It is desirable to provide a display panel capable of decreasing the occurrence of the luminance unevenness and the chromaticity shift due to transient when driving at high speed, a display device including such a display panel and an electronic apparatus.

According to a first embodiment of the present technology, there is provided a display panel including: a plurality of pixels containing three or more subpixels in which the kinds of luminescent colors are different from each other. When k's (k≥2) of pixel rows are set as one unit, this display panel further includes a plurality of scanning lines in which k's are assigned for one unit and which are used for selecting each subpixel, and a plurality of power lines in which one line is assigned for one unit and which are used for supplying each subpixel with the driving current. Each scanning line is connected to a plurality of the subpixels of the same luminescent color within one unit. Each power line is connected to all subpixels within one unit. Here, the coordinates in an u'v' chromaticity diagram of each luminescent color included in one pixel are set as single color coordinates and the coordinates in an u'v' chromaticity diagram of a plurality of kinds of mixed colors capable of being formed by using an two arbitrary colors out of a plurality of luminescent colors included in one pixel are set as mixed color coordinates. At this time, a scanning line of the highest row out of k's of the scanning lines assigned for one unit is connected to the subpixels of one kind or a plurality of kinds of luminescent colors including the subpixels of the luminescent color in which the distance between the single color coordinates and the mixed color coordinates is relatively the shortest.

According to a first embodiment of the present technology, there is provided a display device including: the first display panel and a driving circuit for driving the first display panel.

According to a first embodiment of the present technology, there is provided an electronic apparatus including the first display device.

In the display panel, the display device and the electronic apparatus according to the first embodiment of the present technology, each scanning line used for the selection scanning of each subpixel is connected to a plurality of subpixels of the same luminescent color within one unit. In addition, each power line used for supplying each subpixel with the driving current is connected to all subpixels within one unit. In so doing, for example, after performing the Vth correction with respect to all subpixels within one unit at the same period, the writing of the signal voltage can be performed for each subpixel of the same luminescent color within one unit in order. Here, it is not necessary to typically perform the writing of the signal voltage by separating for each single color. For example, it is naturally possible to perform the writing of the signal voltage at the same period with respect to the subpixels of the other kinds of luminescent colors after performing the writing of the signal voltage at the same period with respect to the subpixels of a plurality of kinds of luminescent colors. As a result, for example, it is possible to collectively perform the Vth correction and the writing of the signal voltage for each unit and it is possible to enhance a high speed driving. In addition, in the driving method described above, in each subpixel of the same luminescent color, the periods from the finish of the Vth correction to the start of the writing of the signal voltage (a waiting time, as it is called) correspond, therefore, it is possible to make the waiting time in the subpixels of the same luminescent color correspond for each line.

In addition, according to the embodiment of the present technology, the scanning line of the highest row out of k's of the scanning lines assigned for one unit is connected to the subpixels of one kind or a plurality of kinds of luminescent colors including the subpixels of the luminescent color in which the distance between the single color coordinates and the mixed color coordinates is relatively the shortest. Here, "subpixel in which the distance between the single color coordinates and the mixed color coordinates is relatively the shortest (hereinafter, referred as a "specific subpixel")" indicates a subpixel in which the change of the light emitting luminance and the chromaticity is relatively the greatest in a case where the signal voltage departs from the desired value. In addition, "the highest row" indicates a scanning line which is selected first in sequence of the signal writing within one unit. That is, according to the embodiment of the present technology, the signal writing into the specific subpixel in sequence of the signal writing within one unit is performed first. Therefore, when the signal writing into the specific subpixel is performed, the timing margin is not limited by the signal writing into the other subpixels.

In the display panel, the display device and the electronic apparatus according to the first embodiment of the present technology, the first display panel may further include a plurality of signal lines in which a's (2≤a<(the total number of the subpixels in one pixel)) are assigned for each pixel in each pixel row and which are used for supplying each subpixel with the signal voltage corresponding to a picture signal. In this case, the first signal line out of a's of the signal lines which are assigned for each pixel in each pixel row may be connected to the subpixels of two kinds of luminescent colors which are not shared with the scanning line in one pixel.

In the display panel, the display device and the electronic apparatus according to the first embodiment of the present technology, the number of the kinds of luminescent colors included in one pixel may be three. In this case, the first signal line may be connected to the subpixels of two kinds of luminescent colors other than the subpixels of the luminescent color in which the distance between the single color coordinates and the mixed color coordinates is relatively the shortest. In addition, in a display panel, a display device and an electronic apparatus according to the first embodiment of the present technology, the number of kinds of luminescent colors included in one pixel may be four. In this case, the second signal line out of a's of the signal lines which are assigned for each pixel in each pixel row may connected to the subpixels of two kinds of luminescent colors which are not shared with the scanning line in one pixel as well as may be connected to the subpixels of two kinds of luminescent colors including the subpixels of the luminescent color in which the distance between the single color coordinates and the mixed color coordinates is relatively the shortest. In addition, the first signal line may be connected to the subpixels of two kinds of luminescent colors which are not connected to the second signal line.

In the display device and the electronic apparatus according to the first embodiment of the present technology, each subpixel may include a light emitting element, a driving transistor for driving the light emitting element and a writing transistor for writing the signal voltage corresponding to the picture signal into the gate of the driving transistor. In this case, a driving circuit may collectively perform the Vth correction in which the voltage between the gate and the source of the driving transistor is set close to the threshold voltage of the driving transistor and the writing of the signal voltage for each unit. In addition, after performing the writing of the signal voltage in each subpixel in one unit with respect to all subpixels connected to the scanning line of the highest row out of k's of the scanning lines which are assigned for one unit, the driving circuit may perform the writing of the signal voltage with respect to all subpixels connected to the other scanning lines.

According to a second embodiment of the present technology, there is provided a display panel including: a plurality of pixels containing three or more subpixels in which the kinds of luminescent colors are different from each other. The display panel further includes a plurality of signal lines in which a's (2≤a<(the total number of the subpixels in one pixel)) are assigned for each pixel in each pixel row and which are used for supplying each subpixel with the signal voltage corresponding to the picture signal. This display panel further includes a plurality of scanning lines in which b's (2≤b≤(the total number of the subpixels in one pixel)) are assigned for each pixel row as well as are connected to a plurality of subpixels of the same luminescent color and are used for selecting each subpixel. Here, the first signal line out of a's of the signal lines which are assigned for each pixel is connected to the subpixels of two kinds of luminescent colors which are not shared with the scanning line in one pixel.

According to a second embodiment of the present technology, there is provided a display device including: the second display panel and a driving circuit for driving the second display panel.

According to a second embodiment of the present technology, there is provided an electronic apparatus including the second display device.

In the display panel, the display device and the electronic apparatus according to the second embodiment of the present technology, each scanning line used for the selection scanning of each subpixel is assigned with b's (2≤b≤(the total number of the subpixels in one pixel)) for each pixel row as well as is connected to a plurality of subpixels of the same luminescent color. In addition, a plurality of signal lines used for the writing of the signal voltage into each subpixel are assigned with a's (2≤a<(the total number of the subpixels in one pixel)) for each pixel in each pixel row. In so doing, for example, after performing the Vth correction with respect to a plurality of subpixels at the same period, the writing of the signal voltage can be performed for each subpixel of the same luminescent color in order. Here, it is not necessary for the writing of the signal voltage to typically perform by separating for each single color. For example, it is naturally possible to perform the writing of the signal voltage at the same period with respect to the subpixels of the other kinds of luminescent colors after performing the writing of the signal voltage at the same period with respect to the subpixels of a plurality of kinds of luminescent colors. In any cases, in each subpixel in the same luminescent color, the periods from the finish of the Vth correction to the start of writing of a signal voltage (the waiting time, as it is called) correspond, therefore, it is possible to make the waiting time in the subpixels of the same luminescent color correspond for each line.

In addition, according to the embodiment of the present technology, it is possible to perform the signal writing into the subpixels which are easily affected due to transient in sequence of the signal writing according to an embodiment of the connection between a signal line and a subpixel and an embodiment of the connection between a scanning line and a subpixel first, perform the signal writing into the subpixels which are not easily affected due to transient along with the subpixels which are easily affected due to transient and perform in the middle or at the end of the sequence. Therefore, when the signal writing into the subpixels which are easily affected due to transient is performed, it is possible for the timing margin not to be limited by the signal writing into the other subpixels.

In the display panel, the display device and the electronic apparatus, according to the second embodiment of the present technology, the number of the kinds of luminescent colors included in one pixel may be three. Here, the coordinates in an u'v' chromaticity diagram of each luminescent color included in one pixel are set as single color coordinates and the coordinates in an u'v' chromaticity diagram of a plurality of kinds of mixed colors capable of being formed by using two arbitrary colors out of a plurality of luminescent colors included in one pixel are set as mixed colors coordinates. At this time, the first signal line may be connected to the subpixels of two kinds of luminescent colors other than the subpixels of the luminescent color in which the distance between the single color coordinates and the mixed color coordinates is relatively the shortest. In addition, in the display panel, the display device and the electronic apparatus according to the second embodiment of the present technology, the number of the kinds of luminescent colors included in one pixel may be four. Here, the coordinates in an u'v' chromaticity diagram of each luminescent color included in one pixel are set as single color coordinates and the coordinates in an u'v' chromaticity diagram of a plurality of kinds of mixed colors capable of being formed by using two arbitrary colors out of a plurality of luminescent colors included in one pixel are set as mixed color coordinates. At this time, the second signal line out of a's of the signal lines which are assigned for each pixel may be connected to the subpixels of two kinds of luminescent colors which are not shared with the scanning line in one pixel as well as may be connected to the subpixels of two kinds of luminescent colors including the subpixels of the luminescent color in which the distance between the single color coordinates and the mixed color coordinates is relatively the shortest. In addition, the first signal line may be connected to the subpixels of two kinds of luminescent colors which are not connected to the second signal line. In addition, the first signal line may be connected to the subpixels of two kinds of luminescent colors including the subpixels of the luminescent color in which the distance between the single color coordinates and the mixed color coordinates is relatively the second shortest.

According to a third embodiment of the present technology, there is provided a display device including: a display panel and a driving circuit for driving a display panel. The display panel contains a plurality of pixels including a plurality of subpixels in which the kinds of luminescent colors are different from each other. Each subpixel includes a light emitting element, a driving transistor for driving a light emitting element and a writing transistor for writing a signal voltage corresponding to a picture signal into a gate of the driving transistor. A driving circuit collectively performs the Vth correction in which the voltage between a gate and a source of the driving transistor is set close to the threshold voltage of the driving transistor and the writing of the signal voltage for each unit when k's ($k \geq 2$) of the pixel rows are set as one unit. Here, the coordinates in an u'v' chromaticity diagram of each luminescent color included in one pixel are set as single color coordinates and the coordinates in an u'v' chromaticity diagram of a plurality of kinds of mixed colors capable of being formed by using two arbitrary colors out of a plurality of luminescent colors included in one pixel are set as mixed colors coordinates. At this time, after performing the writing of the signal voltage into each subpixel in one unit with respect to the subpixels of one kind or a plurality of kinds of luminescent colors including the subpixels of the luminescent colors in which the distance between the single color coordinates and the mixed color coordinates is relatively the shortest, the driving circuit performs the writing of the signal voltage with respect to the subpixels of one kind or a plurality of kinds of luminescent colors in which the kinds of luminescent colors are different from the subpixels thereof.

According to a third embodiment of the present technology, there is provided an electronic apparatus including the third display device.

In the display device and the electronic apparatus according to the third embodiment of the present technology, the Vth correction and the signal writing are collectively performed for each unit. In so doing, it is possible to enhance a high speed driving. In addition, in the driving method described above, in each subpixel of the same luminescent color, the periods from the finish of the Vth correction to the start of the writing of the signal voltage (a waiting time, as it is called) correspond, therefore, it is possible to make the waiting time in the subpixels of the same luminescent color correspond for each line.

In addition, according to the embodiment of the present technology, after performing the writing of the signal voltage into each subpixel in one unit with respect to the subpixels of one kind or a plurality of kinds of luminescent colors including the subpixels of the luminescent color in which the distance between the single color coordinates and the mixed color coordinates is relatively the shortest, the writing of the signal voltage is performed with respect to the subpixels of one kind or a plurality of kinds of luminescent colors in which the kinds of luminescent colors are different from the subpixels thereof. Here, "subpixel in which the distance between the single color coordinates and the mixed color coordinates is relatively the shortest (hereinafter, referred as a "specific subpixel")" indicates a subpixel in which the change of the light emitting luminance and the chromaticity is relatively the greatest in a case where the signal voltage departs from the desired value. That is, according to the embodiment of the present technology, the signal writing into the specific subpixel in sequence of the signal writing within one unit is performed first. Therefore, when the signal writing into the specific subpixel is performed, the timing margin is not limited by the signal writing into the other subpixels.

In the display device and the electronic apparatus according to the third embodiment of the present technology, the number of the kinds of luminescent colors included in one pixel may be three. In this case, after performing the writing of the signal voltage into each subpixel in one unit with respect to the subpixels of one kind or two kinds of luminescent colors including the subpixels of the luminescent colors in which the distance between the single color coordinates and the mixed color coordinates is relatively the shortest, the driving circuit may perform the writing of the signal voltage with respect to the subpixels of the kind of the luminescent colors in which the kinds of luminescent colors are different from the subpixels thereof. In addition, in the display device and the electronic apparatus according to the third embodiment of the present technology, the number of the kinds of luminescent colors included in one pixel may be four. In this case, after performing the writing of the signal voltage into each subpixel in one unit with respect to the subpixels of one kind or two kinds of luminescent colors including the subpixels of the luminescent colors in which the distance between the single color coordinates and the mixed color coordinates is relatively the shortest, the driving circuit may perform the writing of the signal voltage with respect to the subpixels of the kind of the luminescent colors in which the kinds of luminescent colors are different from the subpixels thereof.

In the first and second display panels, the first or third display device and the first or third electronic apparatus, according to the embodiments of the present technology, since it became possible to make the waiting time in the subpixels of the same luminescent color correspond for each line and further, it became possible for the timing margin not to be limited by the signal writing into the other subpixels when the signal writing into the specific subpixel is performed, it is possible to decrease the occurrence of the luminance unevenness and the chromaticity shift due to transient when driving at high speed.

BRIEF DESCRIPTION OF THE DRAWINGS

FIG. 7 is a view representing an example of a voltage of DTL in FIG. 3 and FIG. 4;

DETAILED DESCRIPTION OF EMBODIMENTS

Hereinafter, embodiments of the present technology will be described in detail with reference to the drawings. Here, the order of the description will be as follows.

1. First Embodiment (Display Device)
2. Modified Example of First Embodiment (Display Device)
3. Second Embodiment (Display Device)
4. Application Examples (Electronic Apparatus)

1. First Embodiment

Configuration

Figure 1:
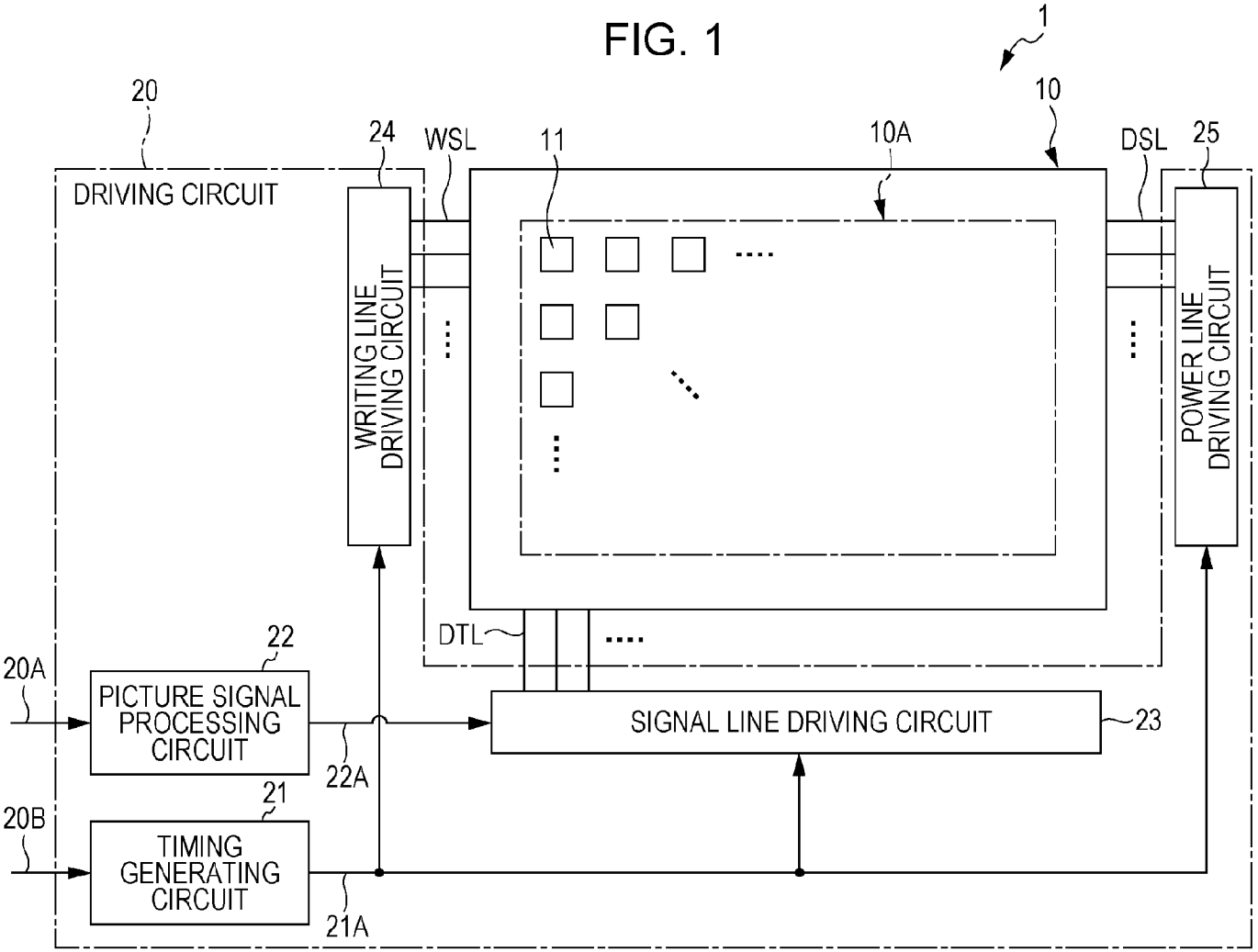
FIG. 1 is a schematic configuration view of a display device according to the first embodiment of the present technology.

FIG. 1 represents a schematic configuration of a display device 1 according to the first embodiment of the present technology. This display device 1 includes a display panel 10 and a driving circuit 20 for driving the display panel 10 based on a picture signal 20A and a synchronized signal 20B which have been input externally. The driving circuit 20, for example, includes a timing generating circuit 21, a picture signal processing circuit 22, a signal line driving circuit 23, a scanning line driving circuit 24 and a power line driving circuit 25.

Display Panel 10

The display panel 10 is a display panel in which a plurality of pixels 11 are arranged in two dimensions over the entire surface of a display region 10A of the display panel 10. The display panel 10 displays an image based on a picture signal 20A which has been input externally by each pixel 11 being driven by an active-matrix driving by the driving circuit 20.

Figure 2:
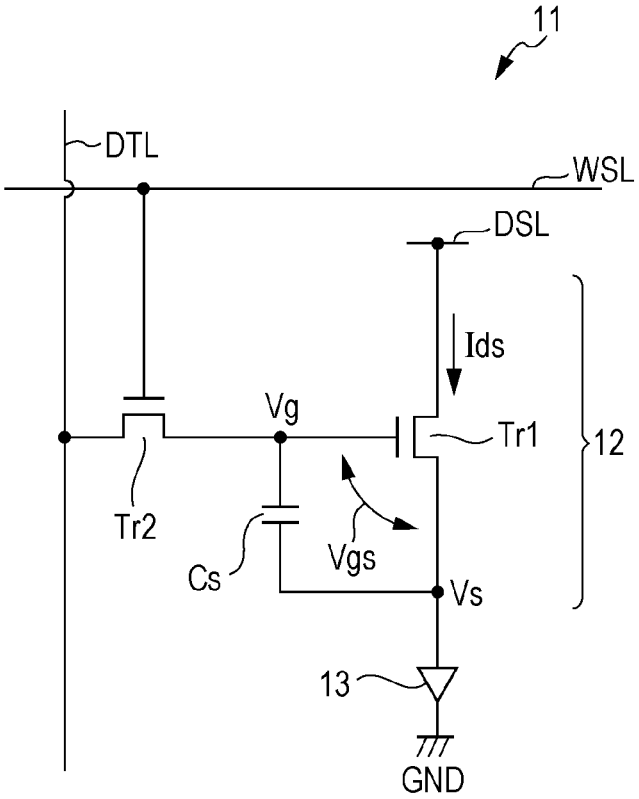
FIG. 2 is a view representing an example of the configuration of a circuit of a pixel in FIG. 1.

FIG. 2 represents an example of the configuration of a circuit of a pixel 11. Each pixel 11, for example, includes a pixel circuit 12 and an organic EL element 13. The organic EL element 13, for example, has a configuration in which an anode electrode, an organic layer and a cathode electrode are laminated in order. The organic EL element 13 includes an element capacity Coled (not shown). The pixel circuit 12, for example, is configured by a driving transistor Tr1, a writing transistor Tr2 and a retention capacity Cs, and is a configuration of a circuit of 2Tr1C.

The writing transistor Tr2 controls an application of the signal voltage corresponding to the picture signal with respect to the gate of the driving transistor Tr1. Specifically, the writing transistor Tr2 samples a voltage of a signal line DTL described later as well as writes into the gate of the driving transistor Tr1. The driving transistor Tr1 drives the organic EL element 13 and is connected to the organic EL element 13 in series. The driving transistor Tr1 controls the current which flows to the organic EL element 13 corresponding to the size of voltage which has been written by the writing transistor Tr2. The retention capacity Cs retains the predetermined voltage between a gate and a source of the driving transistor Tr1. Here, the pixel circuit 12 may be configured by a circuit which is different from the configuration of a circuit of 2Tr1C described above. For example, the pixel circuit 12 may be configured by a circuit of 2Tr2C in which an auxiliary capacity Csub is connected to the source of the driving transistor Tr1.

The driving transistor Tr1 and the writing transistor Tr2, for example, are formed by a thin film transistor (TFT) of an n-channel MOS type. Here, the kinds of TFTs are not particularly limited, for example, there may be a reverse stagger structure (a bottom gate type, as it is called) and there may be a stagger structure (a top gate type). In addition, the driving transistor Tr1 and the writing transistor Tr2 may be formed by a TFT of a p-channel MOS type.

The display panel 10 includes a plurality of scanning lines WSL extending in the row direction, a plurality of signal lines DTL extending in the column direction and a plurality of power lines DSL extending in the row direction. The scanning line WSL is used for selecting each pixel 11. The signal line DTL is used for supplying each pixel 11 with a signal voltage corresponding to a picture signal. The power line DSL is used for supplying each pixel 11 with the driving current.

The pixels 11 are provided in the vicinity of the intersection between each signal line DTL and each scanning line WSL. Each signal line DTL is connected to an output terminal (not shown) of the signal line driving circuit 23 described later and the source or the drain of the writing transistor Tr2. Each scanning line WSL is connected to an output terminal (not shown) of the scanning line driving circuit 24 described later and the gate of the writing transistor Tr2. Each power line DSL is connected to an output terminal (not shown) of a power which outputs a fixed voltage and the source or the drain of the driving transistor Tr1.

The gate of the writing transistor Tr2 is connected to the scanning line WSL. The source or the drain of the writing transistor Tr2 is connected to the signal line DTL and the terminal, which is not connected to the signal line DTL, out of the source and the drain of the writing transistor Tr2, is connected to the gate of the driving transistor Tr1. The source or the drain of the driving transistor Tr1 is connected to the power line DSL and the terminal, which is not connected to the power line DSL, out of the source and the drain of the driving transistor Tr1, is connected to an anode of the organic EL element 13. One end of the retention capacity Cs is connected to the gate of the driving transistor Tr1 and another end of the retention capacity Cs is connected to the source of the driving transistor Tr1 (the terminal of the organic EL element 13 side in FIG. 2). That is, the retention capacity Cs is inserted into between the gate and the source of the driving transistor Tr1.

The display panel 10 further includes a ground line GND which is connected to a cathode of the organic EL element 13 as shown in FIG. 2. The ground line GND is electrically connected to an external circuit (not shown) which is a ground potential. The ground line GND, for example, is a sheet-like electrode which is formed over the entire display region 10A. Here, the ground line GND may be a belt-like electrode which is formed with a striped pattern corresponding to a pixel row or a pixel column. The display panel 10 further includes, for example, a frame region which does not display a picture on the periphery of the display region 10A. The flame region, for example, is covered by a light-resistant member.

Figure 3:
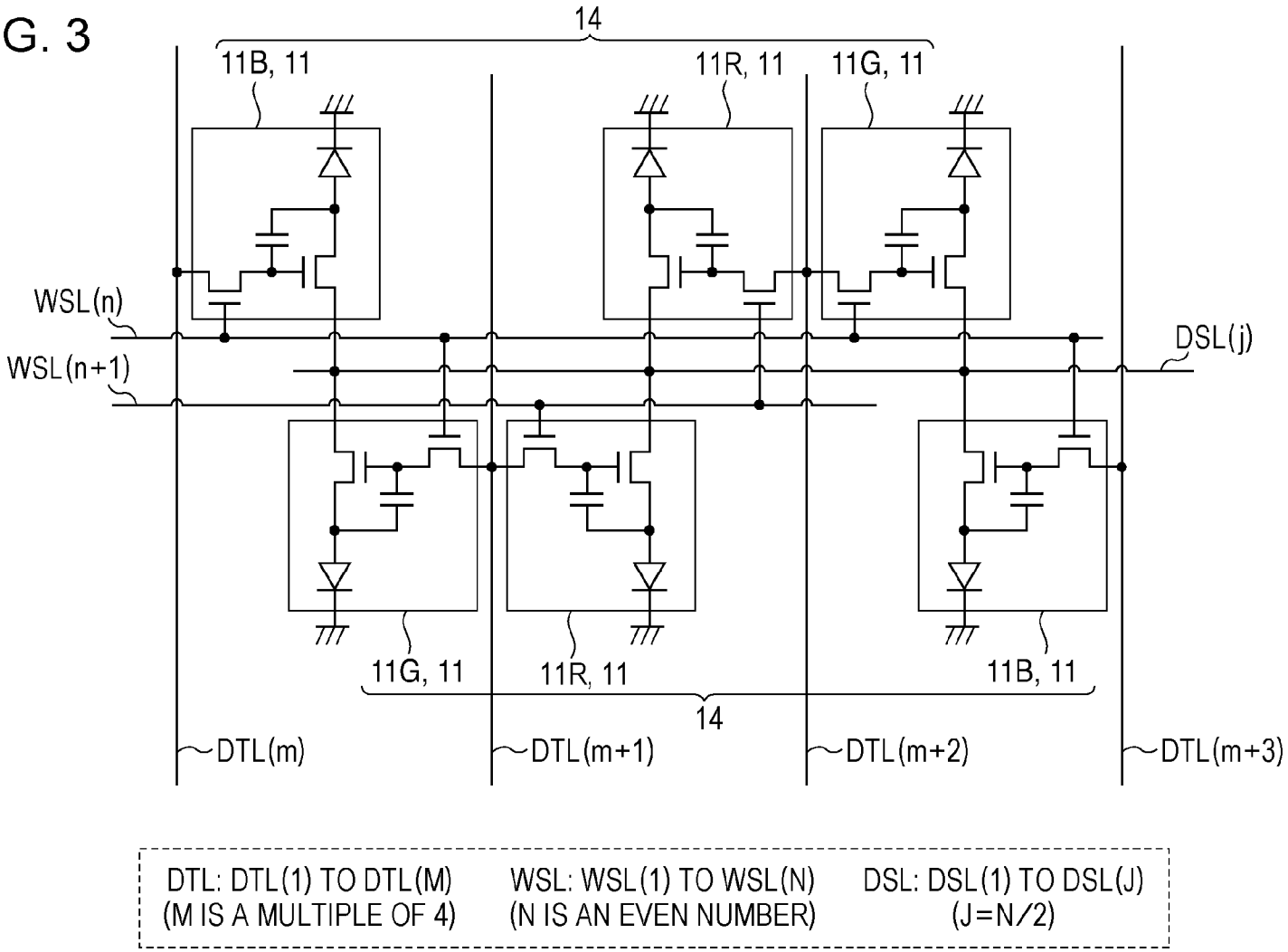
FIG. 3 is a view representing an example of a layout of each pixel in FIG. 1.
Figure 4:
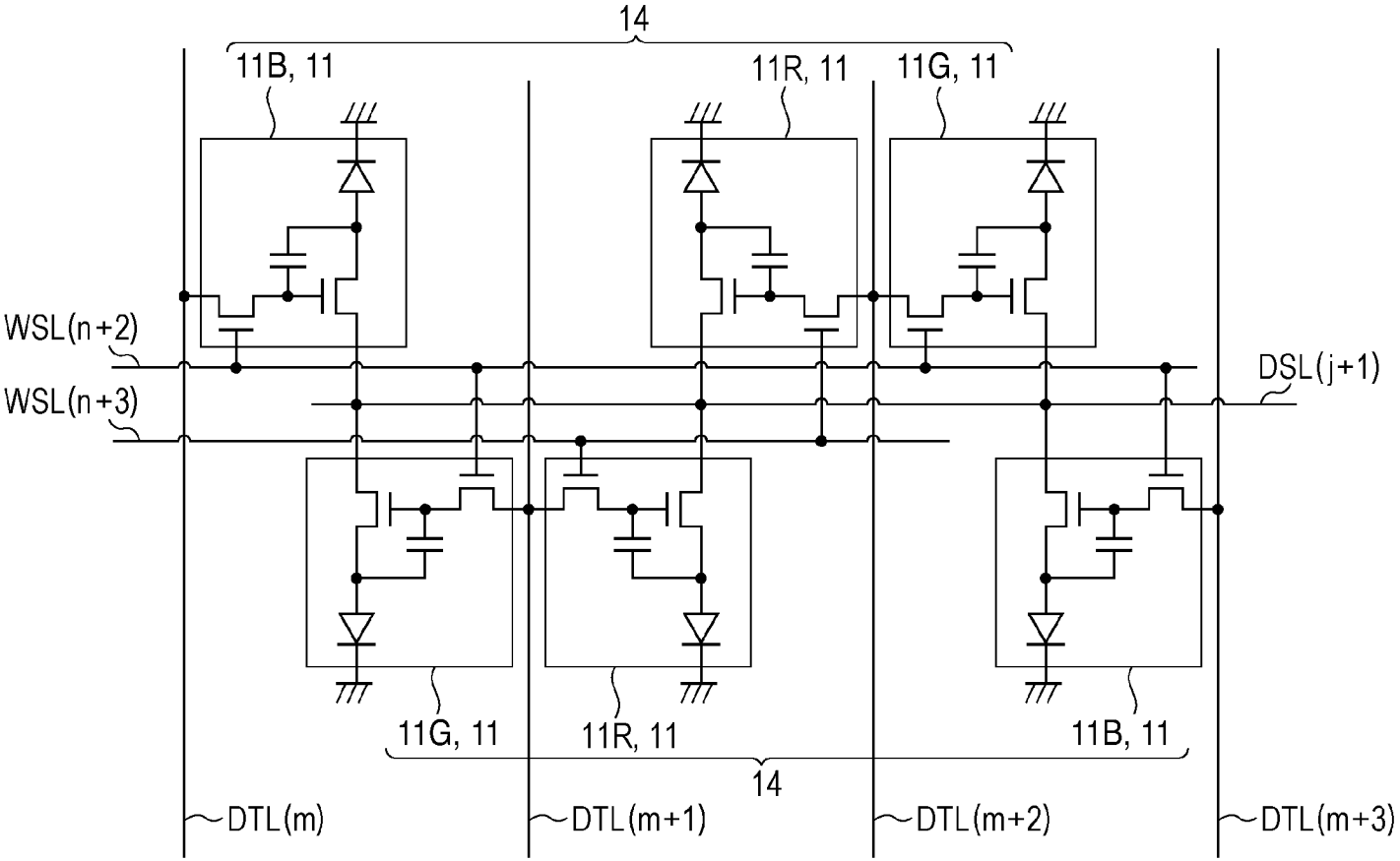
FIG. 4 is a view representing another example of the layout of each pixel in FIG. 1.

FIG. 3 and FIG. 4 represent an example of the configuration of a circuit in two display pixels 14 (described later) which are adjacent to each other in the column direction. FIG. 3 represents an example of a layout of each pixel 11 in the display pixel rows of n-th row ($1 \leq n < N$, N is the total number of the display pixel rows (even number)) and n+1-th row and FIG. 4 represents an example of a layout of each pixel 11 in the display pixel rows of n+2-th row and n+3-th row.

Here, a display pixel row indicates a line which is formed by a plurality of display pixels 14 arranged alongside in the row direction. On the other hand, a pixel row indicates a line which is formed by a plurality of pixels 11 arranged alongside in the row direction and is equivalent to a subpixel row. In the embodiment, the display pixel row and the pixel row substantially indicate the same lines and it is not necessary to use the display pixel row and the pixel row properly with each other. However, in the modified examples of the embodiment, it is necessary to use the display pixel row and the pixel row properly with each other. So, hereinafter, in order to avoid mixing the pixel row and the display pixel row, the pixel row is referred to as a subpixel row.

The layouts of each pixel 11 in the display pixel rows of n-th row and n+1-th row and in the display pixel rows of n+2-th row and n+3-th row are common. So, hereinafter, in order to avoid a repeating description, description of the layouts of each pixel 11 in the display pixel rows of n+2-th row and n+3-th row will be omitted.

Each pixel 11 corresponds to a dot of the minimum unit configuring a screen on the display panel 10. The display panel 10 is a color display panel and the pixel 11, for example, is equivalent to the subpixel which emits a single color light such as red, green or blue. In the embodiment, a display pixel 14 is configured by three pixels 11 in which the kinds of luminescent colors are different from each other. That is, the number of the kinds of luminescent colors is three and the number of the pixels 11 which are included in each display pixel 14 is also three. Three pixels 11 included in the display pixel 14 are configured by a pixel 11R which emits red light, a pixel 11G which emits green light and a pixel 11B which emits blue light.

When k's (k≥2) of the display pixel rows are set as one unit, a plurality of scanning lines WSL are assigned with k's for one unit. The number of the display pixel rows included in one unit is two or more and the number of the kinds of luminescent colors or less. Therefore, k is satisfied with 2≤k≤(the total number of the kinds of luminescent colors of the pixel 11 in one display pixel 14). Specifically, when two display pixel rows are set as one unit, a plurality of scanning lines WSL are assigned with two lines for one unit. Therefore, the number of the display pixel rows included in one unit is two and the number of the scanning lines WSL included in one unit is also two. The total number of the scanning lines WSL is equal to the total number of the display pixel rows and is N. Here, n in FIG. 3 is a positive integer of one or more and N/2 or less and WSL (n) in FIG. 3 indicates the scanning line WSL of n-th number.

Each scanning line WSL is connected to a plurality of pixels 11 of the same luminescent color within one unit. Specifically, in two of the scanning lines WSL (n) and WSL (n+1) included in one unit, the scanning line WSL (n) (the first scanning line) is connected to a plurality of pixels 11G and a plurality of pixels 11B included in one unit and the scanning line WSL (n+1) is connected to a plurality of pixels 11R included in one unit. Here, in the embodiment, in two of the scanning lines WSL (n) and WSL (n+1) included in one unit, the scanning line WSL (n) is equivalent to a scanning line of "the upper row" or "the highest row" and the scanning line WSL (n+1) is equivalent to a scanning line of "the lower row" or "the bottom row".

Here, "the upper row" indicates a scanning line which is selected in the first half in sequence of the signal writing within one unit. "the highest row" indicates a scanning line which is selected first in sequence of the signal writing within one unit. In addition, "the lower row" indicates a scanning line which is selected in the last half in sequence of the signal writing within one unit. "the bottom row" indicates a scanning line which is selected at the last in sequence of the signal writing within one unit.

In addition, each scanning line WSL is connected to all pixels 11 of the same luminescent color within one unit. Specifically, in two of the scanning lines WSL (n) and WSL (n+1) included in one unit, the scanning line WSL (n) is connected to all pixels 11G and all pixels 11B within one unit and the scanning line WSL (n+1) is connected to all pixels 11R within one unit.

A plurality of power lines DSL are assigned with one line for one unit. Therefore, the number of the power lines DSL included in one unit is one. The total number of the power lines DSL is equivalent to the half of the total number of the pixel rows and is J (=N/2). Here, j in FIG. 3 is a positive integer of one or more and N/2 or less and DSL (j) in FIG. 3 indicates a power line DSL of j-th number. Each power line DSL is connected to all pixels 11 within one unit. Specifically, one power line DSL included in one unit is connected to all pixels 11 (11R, 11G and 11B) included in one unit.

A plurality of signal lines DTL are assigned with a's (2≤a<(the total number of the subpixels in one pixel)) for each display pixel 14 in each display pixel row. Specifically, a plurality of the signal lines DTL are assigned with two lines for each display pixel 14 in each display pixel row. In a's of the signal lines DTL assigned for each display pixel 14 in each display pixel row, one signal line DTL (the first signal line) is connected to the pixels 11 of two kinds of luminescent colors which are not shared with the scanning line WSL in one display pixel 14. Specifically, in two signal lines DTL assigned for each display pixel 14 in each display pixel row, one signal line DTL (the first signal line) is connected to the pixels 11 of two kinds of luminescent colors which do not share the scanning line WSL in one display pixel 14 and the other signal line DTL is connected to the pixels 11 of the remaining kinds (one kind or a plurality of kinds) of luminescent colors in one display pixel 14.

More specifically, two display pixels 14 which are adjacent to each other in the column direction (that is, two display pixels 14 in which rows are different from each other and are adjacent to each other within one unit) out of a plurality of display pixels 14 included in the pixel row of n-th row and n+1-th row are focused. In the display pixel 14 included in the display pixel row of n-th row out of these two display pixels 14, two of the signal lines DTL (m) and DTL (m+2) are assigned. Here, the number of the signal lines DTL is equal to the number of the pixels 11 included in one pixel row and is M (M is a multiple of 4). In FIG. 3, m is a positive integer of one or more and M−4 or less, and is the number which is equivalent to (a multiple of 4+1) in a case of being other than 1. Therefore, DTL (m) in FIG. 3 indicates a signal line DTL of m-th number.

In two of the signal lines DTL (m) and DTL (m+2) described above, one signal line DTL (m+2) (the first signal line) is connected to the pixels 11R and 11B of two kinds of luminescent colors which are not shared with the scanning line WSL in one display pixel 14 and the other signal line DTL (m) is connected to the pixel 11G of the remaining one kind of luminescent color. In addition, in display pixel 14 included in the pixel row of n+1-th row out of two display pixels 14 described above, two of the signal lines DTL (m+1) and DTL (m+3) are assigned. In two of the signal lines DTL (m+1) and DTL (m+3), one signal line DTL (m+1) (the first signal line) is connected to the pixels 11R and 11B of two kinds of luminescent colors which are not shared with the scanning line WSL in one display pixel 14 and the other signal line DTL (m+3) is connected to the pixel 11G of the remaining kinds of luminescent colors. That is, in two display pixels 14 in which the display pixel rows are different from each other and are adjacent to each other within one unit, two of signal lines DTL (m) and DTL (m+2) of an even number of column are assigned with respect to one display pixel 14 and two of signal lines DTL (m+1) and DTL (m+3) of an odd number of column are assigned with respect to the other display pixel 14. In so doing, the total number of the signal lines DTL is suppressed to a minimum.

In two display pixels 14 in which the display pixel rows are different from each other and are adjacent to each other within one unit, the combination of the luminescent colors of the pixels 11 of two kinds of luminescent colors which share the scanning line WSL is equal to each other. On the other hand, in two display pixels 14 in which the display pixel rows are different from each other and are adjacent to each other within one unit, the arrangements of the luminescent colors are different from each other. For example, in the upper row within one unit, three pixels 11 are arranged in the row direction in the order of GRB and in the lower row within one unit, three pixels 11 are arranged in the row direction in the order of BRG.

Kinds of Luminescent Colors

Next, the combination of k's of the scanning lines WSL assigned for one unit and the kinds of luminescent colors of the pixels 11 included in the display pixel 14 will be described. In addition, the combination of a's of the signal lines DTL assigned for each display pixel 14 in each display pixel row and the kinds of luminescent colors of the pixels 11 included in the display pixel 14 will be described.

Figure 5:
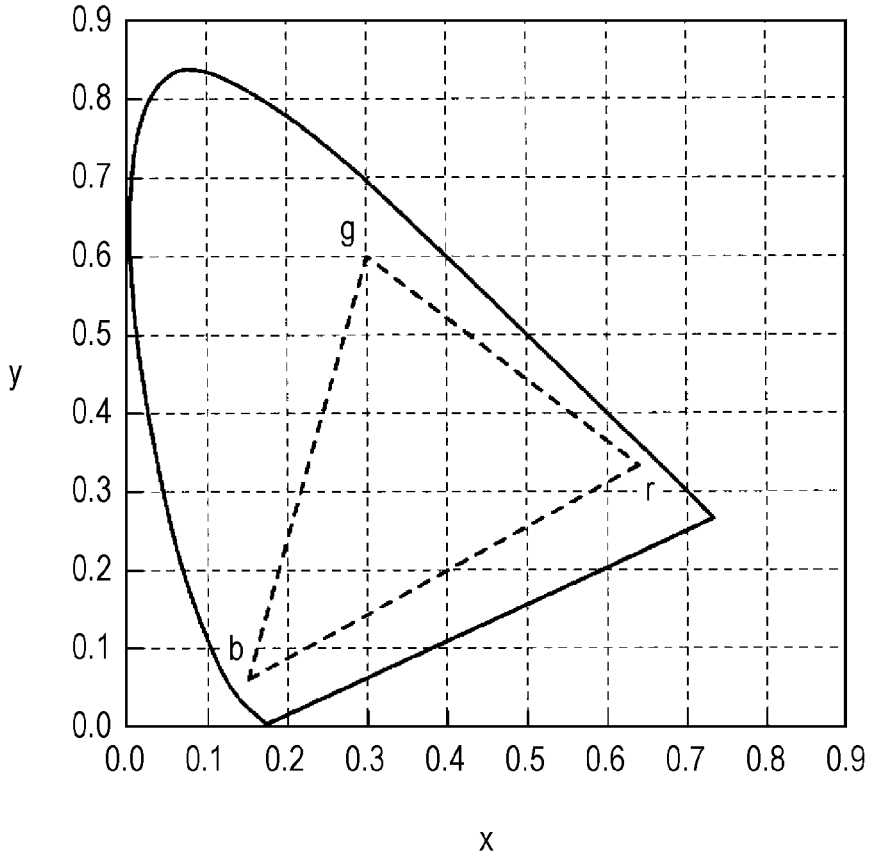
FIG. 5 is a xy chromaticity diagram in which the coordinates of RGB are plotted.
Figure 6:
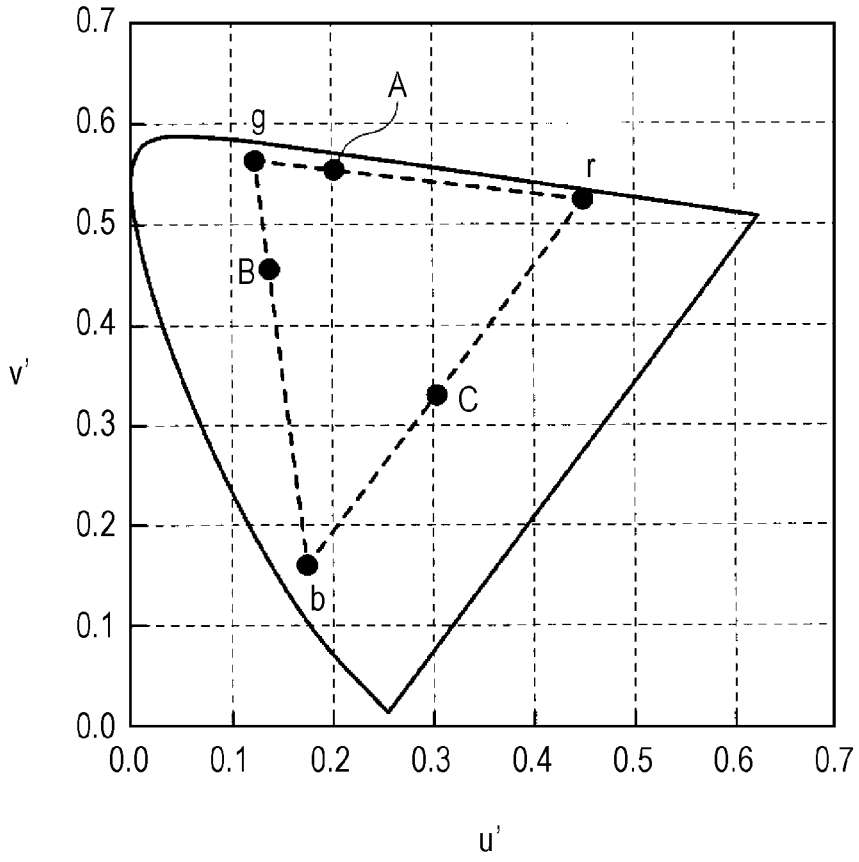
FIG. 6 is an u'v' chromaticity diagram in which the coordinates of RGB and intermediate colors thereof are plotted.

FIG. 5 is a xy chromaticity diagram in which the coordinates of the chromaticity of the luminescent color of three pixels 11 included in the display pixel 14 are plotted. FIG. 6 is an u'v' chromaticity diagram in which the coordinates (the single color coordinates) of the chromaticity of the luminescent color of three pixels 11 included in the display pixel 14 are plotted again using the formulae 1, 2 and 3 as follows.

$$X = \frac{x}{y}L \qquad \text{Formula 1}$$

$$Y = L$$

$$Z = \frac{1-x-y}{y}L$$

$$\begin{bmatrix} X \\ Y \\ Z \end{bmatrix} = \begin{bmatrix} 0.4124 & 0.3576 & 0.1805 \\ 0.2126 & 0.7152 & 0.0722 \\ 0.0193 & 0.1192 & 0.9505 \end{bmatrix} \begin{bmatrix} R \\ G \\ B \end{bmatrix} \qquad \text{Formula 2}$$

$$u' = \frac{4X}{X+15Y+3Z} \qquad \text{Formula 3}$$

$$v' = \frac{9Y}{X+15Y+3Z}$$

A, B and C in FIG. 6 are plots of the coordinates (the mixed color coordinates) in an u'v' chromaticity diagram of three mixed colors capable of being formed by using two arbitrary colors out of three luminescent colors included in one display pixel 14. Specifically, A in FIG. 6 is a plot of the coordinates in an u'v' chromaticity diagram of the mixed colors of the luminescent color (red) of pixel 11R and the luminescent color (green) of the pixel 11G. B in FIG. 6 is a plot of the coordinates in an u'v' chromaticity diagram of the mixed colors of the luminescent color (green) of the pixel 11G and the luminescent color (blue) of the pixel 11B. C in FIG. 6 is a plot of the coordinates in an u'v' chromaticity diagram of the mixed colors of the luminescent color (blue) of the pixel 11B and the luminescent color (red) of the pixel 11R.

As described above, each scanning line WSL is connected to a plurality of pixels 11 of the same luminescent color within one unit. At this time, in k's of the scanning lines WSL assigned for one unit, the scanning line WSL (the first scanning line) of the highest row is connected to the pixels 11 of one kind or a plurality of kinds of luminescent colors including the pixel 11 of the luminescent color in which the distance between the single color coordinates and the mixed color coordinates is relatively the shortest. In the embodiment, it is understood that the pixel 11 of the luminescent color in which the distance between the single color coordinates and the mixed color coordinates is relatively the shortest is the pixel 11G according to FIG. 6. Therefore, for example, in two scanning lines WSL assigned for one unit, the scanning line WSL (the first scanning line) of the highest row is connected to the pixels 11G and 11B of two kinds of luminescent colors including the pixel 11G in which the distance between the single color coordinates and the mixed color coordinates is relatively the shortest. At this time, the scanning line WSL of the bottom row is connected to the pixel 11R of one kind of luminescent color. Here, although not shown, in k's of the scanning lines WSL assigned for one unit, the scanning line WSL (the first scanning line) of the highest row may be connected to the pixels 11G and 11R of two kinds of luminescent colors including the pixel 11G in which the distance between the single color coordinates and the mixed color coordinates is relatively the shortest. At this time, the scanning line WSL of the bottom row is connected to the pixel 11B of one kind of the luminescent color.

In addition, as described above, in a's (2≤a<(the total number of the subpixels in one pixel)) of the signal lines DTL assigned for each display pixel 14 in each display pixel row, one signal line DTL (the first signal line) is connected to the pixels 11 of two kinds of luminescent colors which are not shared with the scanning line WSL in one display pixel 14. In the embodiment, two signal lines DTL are assigned for each display pixel 14 in each display pixel row and further, the number of the kinds of luminescent colors included in one display pixel 14 is three. Therefore, one signal line DTL (the first signal line) is connected to the pixels 11 of the two kinds of luminescent colors other than the pixel 11 of the luminescent color in which the distance between the single color coordinates and the mixed color coordinates is relatively the shortest. In the embodiment, it is understood that the pixel 11 of the luminescent color in which the distance between the single color coordinates and the mixed color coordinates is relatively the shortest is the pixel 11G according to FIG. 6. Therefore, for example, one signal line DTL (the first signal line) is connected to the pixels 11R and 11B of two kinds of luminescent colors other that the pixel 11G. At this time, the remaining signal line DTL is connected to the pixel 11G.

Driving Circuit 20

Next, a driving circuit 20 will be described. The driving circuit 20, for example, includes a timing generating circuit 21, a picture signal processing circuit 22, a signal line driving circuit 23, a scanning line driving circuit 24 and a power line driving circuit 25 as described above. The timing generating circuit 21 is a control circuit so that each circuit operates together within the driving circuit 20. The timing generating circuit 21, for example, outputs a control signal 21A with respect to each circuit described above according to a synchronized signal 20B which have been input externally (synchronizing).

The picture signal processing circuit 22, for example, performs the predetermined correction with respect to a digital picture signal 20A which has been input externally and outputs a picture signal 22A which has been obtained thereby into the signal line driving circuit 23. As the predetermined correction, for example, a γ correction, an overdrive correction, and the like are included.

The signal line driving circuit 23, for example, applies an analog signal voltage of corresponding to the picture signal 22A which has been input from the picture signal processing circuit 22 according to an input of a control signal 21A (synchronizing) to each signal line DTL. The signal line driving circuit 23, for example, is able to output two kinds of voltages (Vofs and Vsig). Specifically, the signal line driving circuit 23 supplies the pixel 11 which has been selected by the scanning line driving circuit 24 with two kinds of voltages (Vofs and Vsig) through the signal line DTL.

FIG. 7 represents an example of the voltage V (n), V (n+1), V (n+2) and V (n+3) applied in order according to scanning of the scanning line WSL with respect to four signal lines DTL (DTL (m), DTL (m+1), DTL (m+2) and DTL (m+3)) which have been connected to four display pixels 14 arranged in the column direction in two units which are adjacent to each other in the column direction. The signal line driving circuit 23 outputs a signal voltage V (n) corresponding to the selection of the scanning line WSL (n) and outputs a signal voltage V (n+1) corresponding to the selection of the scanning line WSL (n+1). In the same way, the signal line driving circuit 23 outputs a signal voltage V (n+2) corresponding to the selection of the scanning line WSL (n+2) and outputs a signal voltage V (n+3) corresponding to the selection of the scanning line WSL (n+3). Here, the scanning line driving circuit 24 selects the scanning lines WSL in the order of WSL (n), WSL (n+1), WSL (n+2) and WSL (n+3) on the occasion of the writing of the signal voltage as described later. Therefore, the signal line driving circuit 23 outputs the signal voltages Vsigs in the order of V (n), V (n+1), V (n+2) and V (n+3) on the occasion of the writing of the signal voltage.

The signal line driving circuit 23, for example, supplies the voltages Vsigs (Vsig (n, m) and Vsig (n, m+2)) corresponding to the n display pixel row with respect to a plurality of pixels 11 which belong to the n display pixel row out of a plurality of pixels 11 which has been selected at the same time by the scanning line driving circuit 24 through even-numbers of the signal lines DTL (m) and DTL (m+2), as shown in FIG. 7. In addition, the signal line driving circuit 23 supplies the voltages Vsigs (Vsig (n+1, m+1) and Vsig (n+1, m+3)) corresponding to the n+1 display pixel row with respect to a plurality of pixels 11 which belong to the n+1 pixel rows out of a plurality of pixels 11 selected at the same time by the scanning line driving circuit 24 through odd-numbers of the signal lines DTL (m+1) and DTL (m+3).

That is, when the scanning line WSL (n) has been selected on the occasion of the signal writing, the signal line driving circuit 23 outputs the voltages Vsig (n, m) and Vsig (n, m+2) corresponding to the n display pixel row with respect to even-numbers of the signal lines DTL (m) and DTL (m+2) and outputs the voltages Vsig (n, m+1) and Vsig (n, m+3) corresponding to the n+1 display pixel row with respect to odd-numbers of the signal lines DTL (m+1) and DTL (m+3) at the same time. In addition, when the scanning line WSL (n+1) has been selected on the occasion of the signal writing, the signal line driving circuit 23 outputs the voltages Vsig (n+1, m) and Vsig (n+1, m+2) corresponding to the n+1 display pixel row with respect to even-numbers of the signal lines DTL (m) and DTL (m+2) and outputs the voltages Vsig (n, m+1) and Vsig (n, m+3) corresponding to the n display pixel row with respect to odd-numbers of the signal lines DTL (m+1) and DTL (m+3) at the same time. Here, the signal line driving circuit 23 also applies the voltage corresponding to the n+2 pixel row and the n+3 pixel row in the same way as the n pixel row and n+1 pixel row.

Vsig is the voltage value corresponding to the picture signal 20A. Vofs is the constant voltage which is not related to the picture signal 20A. The minimum voltage of Vsig is the voltage value lower than Vofs and the maximum voltage of Vsig is the voltage value higher than Vofs.

The scanning line driving circuit 24, for example, performs the Vth correction, the writing of the signal voltage Vsig and the μ correction in the desired order by selecting a plurality of scanning lines WSL using the predetermined sequence according to the input of the control signal 21A (synchronizing). Here, the Vth correction indicates the correction action in which the voltage Vgs between the gate and the source of the driving transistor Tr1 is set close to the threshold voltage of the driving transistor. The writing of the signal voltage Vsig (the signal writing) indicates the action which writes the signal voltage Vsig with respect to the gate of the driving transistor Tr1 through the writing transistor Tr2. The μ correction indicates the action which corrects the voltage Vgs retained between the gate and the source of the driving transistor Tr1 according to the size of the mobility μ of the driving transistor Tr1. The signal writing and μ correction are often performed at the different timing to each other. In the embodiment, by one selective pulse being input into the scanning line WSL, the scanning line driving circuit 24 performs the signal writing and the μ correction at the same time (or continuously without interval).

Figure 9:
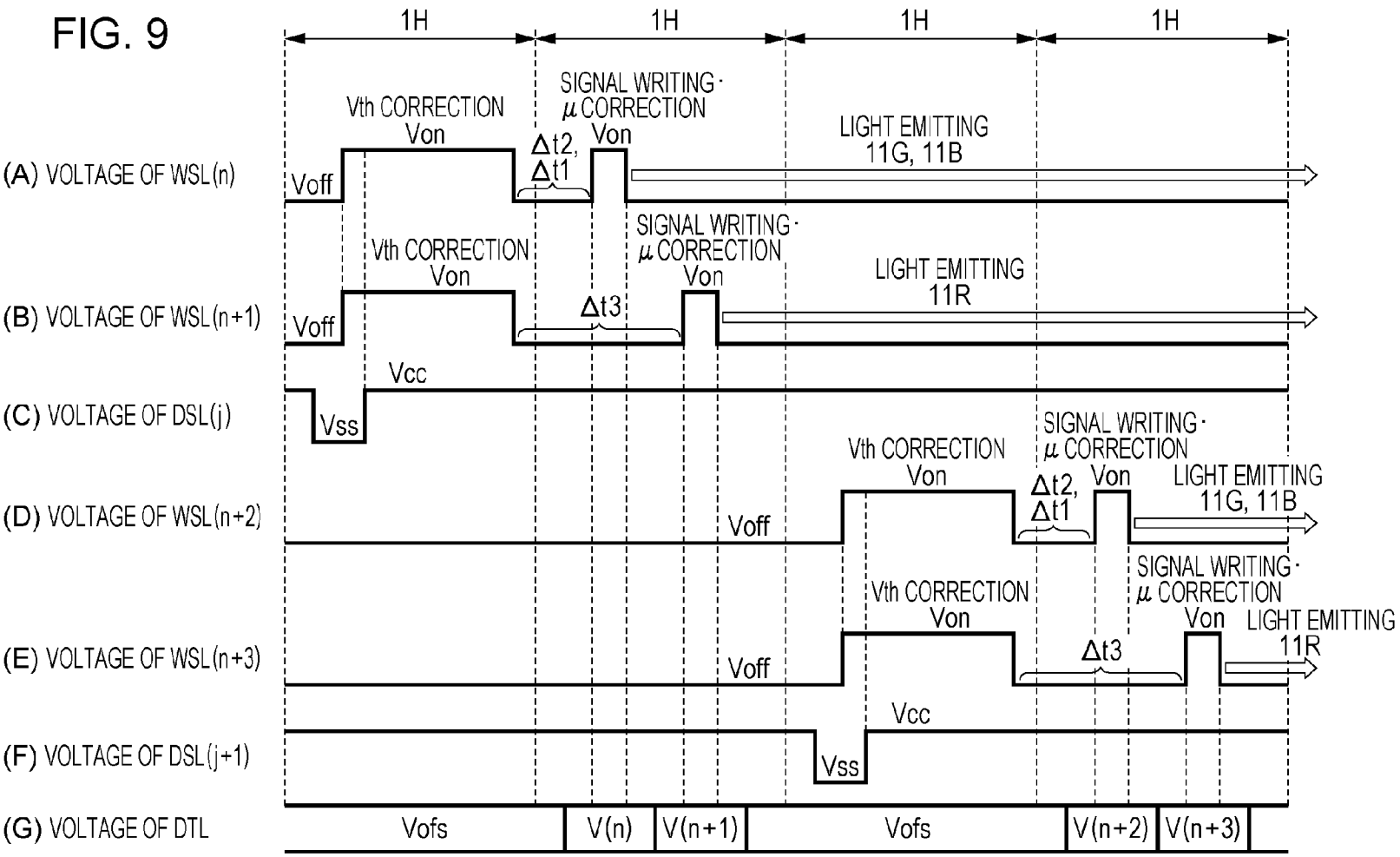
FIG. 9 is a wave form chart for illustrating an example of a scanning of the Vth correction and the signal writing and μ correction in a display device in FIG. 1.

Then, the driving circuit 20 collectively performs the Vth correction and the signal writing for each unit. Specifically, after performing the Vth correction and the signal writing in the first unit, the driving circuit 20 performs the Vth correction and the signal writing in the second unit which is adjacent to the first unit in the column direction, as shown in FIG. 9. That is, the driving circuit 20 performs a series of actions (the Vth correction and the signal writing) per unit in order.

The scanning line driving circuit 24 selects all scanning lines WSL included in one unit at the same time (or at the same period) as the Vth correction. Specifically, the scanning line driving circuit 24 selects two of the scanning lines WSL (n) and WSL (n+1) included in one unit at the same time (or at the same period) as the Vth correction. That is, the scanning line driving circuit 24 selects a plurality of pixels 11(for example, pixels 11R, 11G and 11B) in the n display pixel row and a plurality of pixels 11 (for example, pixels 11R, 11G and 11B) in the n+1 display pixel row at the same time (or at the same period) as the Vth correction.

In addition, the scanning line driving circuit 24 selects a plurality of the scanning lines WSL included in one unit in order in the same direction as the scanning direction (hereinafter, referred to as a "unit scanning direction") of performing a series of actions (the Vth correction and the signal writing) per unit in order on the occasion of the signal writing. The unit scanning direction, for example, is the direction parallel to the direction from the upper end side toward the lower end side of the display panel 10. Therefore, after performing the signal writing into each pixel 11 in one display pixel row with respect to each pixel 11 connected to the scanning line WSL (n), the scanning line driving circuit 24 performs the signal writing with respect to each pixel 11 connected to the scanning line WSL (n+1). Here, the unit scanning direction may be the direction parallel to the direction from the upper end side toward the lower end side of the display panel 10. At this time, although not shown, after performing the signal writing into each pixel 11 in one display pixel row with respect to each pixel 11 connected to the scanning line WSL (n+1), the scanning line driving circuit 24 performs the signal writing with respect to each pixel 11 connected to the scanning line WSL (n).

The scanning line driving circuit 24 selects two of scanning lines WSL (n) and WSL (n+1) included in one unit in the order of the scanning line WSL (n) and the scanning line WSL (n+1) on the occasion of the signal writing. Therefore, after selecting two kinds of pixels 11G and 11B in the n display pixel row and two kinds of pixels 11G and 11B in the n+1 display pixel row through the scanning line WSL (n) at the same time, the scanning line driving circuit 24 selects one kind of pixel 11R in the n display pixel row and one kind of pixel 11R in the n+1 display pixel row through the scanning line WSL (n+1) at the same time, as the signal writing.

The scanning line driving circuit 24, for example, is able to output two kinds of voltages (Von and Voff). Specifically, the scanning line driving circuit 24 supplies the pixel 11 targeted for driving with two kinds of voltages (Von and Voff) through the scanning line WSL and performs an on-off control of the writing transistor Tr2. Here, Von is the value which is greater than or equal to the on-state voltage of the writing transistor Tr2. Von is the peak value of a writing pulse which is output in "the latter half portion of the Vth correction preparation period", "Vth correction period", "Signal writing and μ correction period" or the like described later from the scanning line driving circuit 24. Voff is the value which is lower than on-state voltage of the writing transistor Tr2 and is lower than Von. Voff is the peak value of a writing pulse which is output into "the first half portion of the Vth correction preparation period", "light emitting period" or the like described later from the scanning line driving circuit 24.

The power line driving circuit 25, for example, selects a plurality of power lines DSL for each predetermined unit in order according to the input of the control signal 21A (synchronizing). The power line driving circuit 25, for example, is able to output two kinds of voltages (Vcc and Vss). Specifically, the power line driving circuit 25 supplies the entire one unit (that is, all pixels 11 included in one unit) including pixel 11 selected by the scanning line driving circuit 24 with two kinds of voltages (Vcc and Vss) through the power line DSL. Here, Vss is the voltage value which is lower than the voltage (Ve1+Vcath) in which the threshold voltage Ve1 of the organic EL element 13 and the cathode voltage Vcath of the organic EL element 13 are added together. Vcc is the voltage value which is greater than or equal to the voltage (Ve1+Vcath).

Action

Next, the actions (the actions from extinction to light emitting) of the display device 1 in the embodiment will be described. In the embodiment, even though I-V characteristics of the organic EL element 13 are changed according to time course and the threshold voltage and the mobility of the driving transistor Tr1 are changed according to time course, without being affected thereby the compensation action with respect to the change of I-V characteristics of the organic EL element 13 and the correction action with respect to the change of the threshold voltage and the mobility of the driving transistor Tr1 are incorporated in order to maintain a uniform light emitting luminance of the organic EL element 13.

Figure 8:
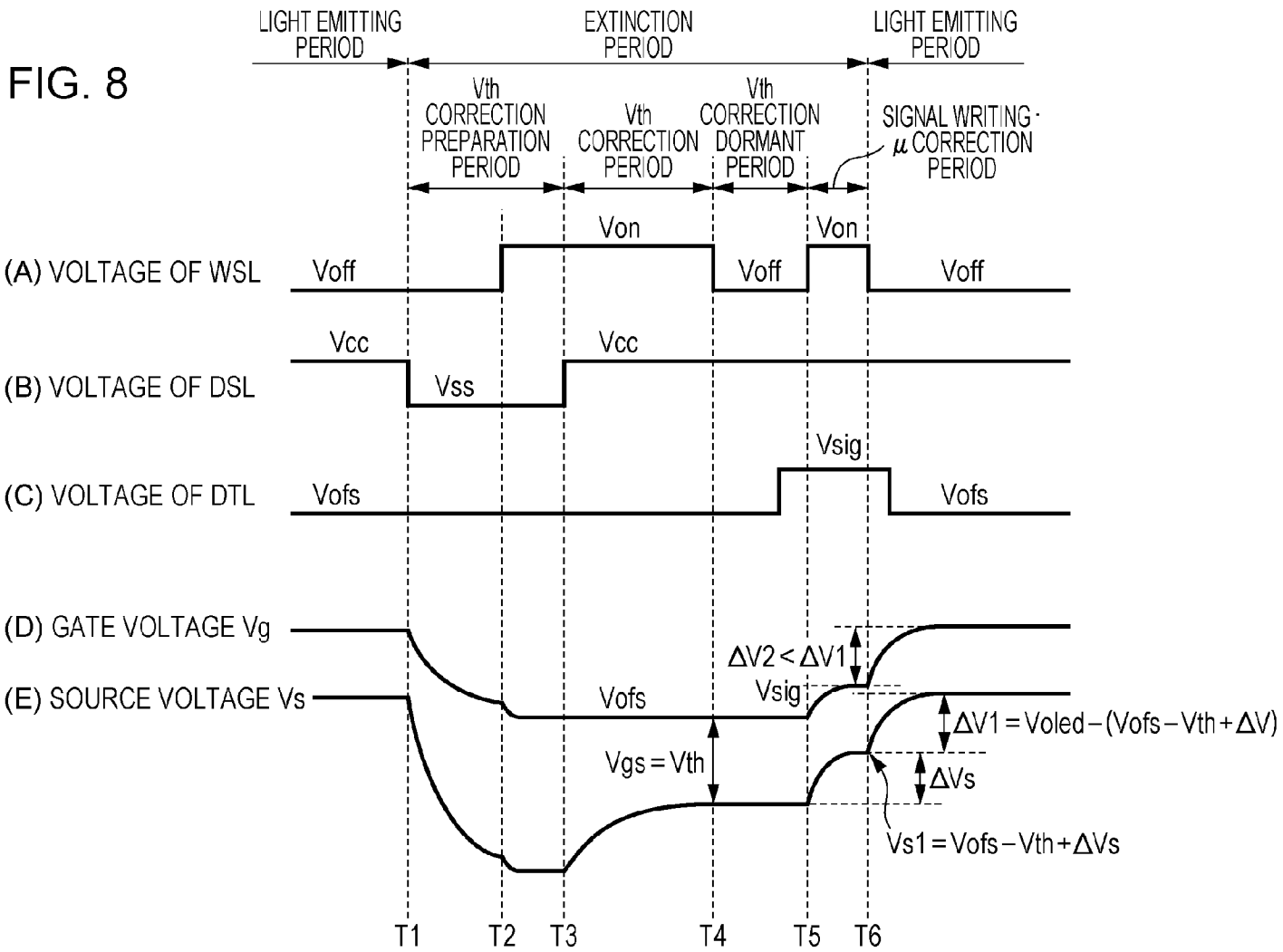
FIG. 8 is a wave form chart for illustrating an example of an action of a display device in FIG. 1.

FIG. 8 represents an example of various kinds of wave forms in the display device 1. FIG. 8 shows the state in which the change in two values of the voltages occurs every moment in the scanning line WSL, the power line DSL and the signal line DTL. In addition, FIG. 8 shows the state in which the gate voltage Vg and the source voltage Vsof of the driving transistor Tr1 change every moment according to the change in the voltage of the scanning line WSL, the power line DSL and the signal line DTL.

Vth Correction Preparation Period

Firstly, the driving circuit 20 performs the preparation of the Vth correction in which the voltage Vgs between the gate and the source of the driving transistor Tr1 is set close to the threshold voltage of the driving transistor Tr1. Specifically, when the voltage of the scanning line WSL is set as Voff, the voltage of the signal line DTL is set as Vofs and the voltage of the power line DSL is set as Vcc (that is, when the organic EL element 13 is emitted), the power line driving circuit 25 decreases the voltage of the power line DSL from Vcc to Vss according to the control signal 21A (T1). Then, the source voltage Vs is decreased to Vss and the organic EL element 13 is quenched. At this time, the gate voltage Vg is also decreased by a coupling through the retention capacity Cs.

Next, while the voltage of the power line DSL is set as Vss and the voltage of the signal line DTL is set as Vofs, the scanning line driving circuit 24 increases the voltage of the scanning line WSL from Voff to Von according to the control signal 21A (T2). Then, the gate voltage Vg is decreased to Vofs. At this time, the potential difference Vgs between the gate voltage Vg and the source voltage Vs may be smaller than, equal to or bigger than the threshold voltage of the driving transistor Tr2.

Vth Correction Period

Next, the driving circuit 20 performs the Vth correction. Specifically, while the voltage of the signal line DTL is set as Vofs and the voltage of the scanning line WSL is set as Von, the power line driving circuit 25 increases the voltage of the power line DSL from Vss to Vcc according to the control signal 21A (T3). Then, current Ids flows into between the drain and the source of the driving transistor Tr1 and the source voltage Vs rises. At this time, in a case where the source voltage Vs is lower than Vofs-Vth (in a case where the Vth correction has not been completed yet), the current Ids flows into between the drain and the source of the driving transistor Tr1 until the driving transistor Tr1 is cut-off (until the potential difference Vgs becomes Vth). In so doing, the gate voltage Vg becomes Vofs, the source voltage Vs rises, and as a result, the retention capacity Cs is charged Vth and the potential difference Vgs becomes Vth.

After this, before the signal line driving circuit 23 switches the voltage of the signal line DTL from Vofs to Vsig according to the control signal 21A, the scanning line driving circuit 24 decreases the voltage of the scanning line WSL from Von to Voff according to the control signal 21A (T4). Then, since the gate of the driving transistor Tr1 becomes floating, it is possible to maintain the potential difference Vgs as Vth in spite of the size of the voltage of the signal line DTL. In doing so, by setting the potential difference Vgs as Vth, even in a case where the threshold voltages Vth of the driving transistor Tr1 vary for each pixel circuit 12, it is possible to stop the variability of the light emitting luminance of the organic EL element 13.

Vth Correction Dormant Period

After this, during the Vth correction dormant period, the signal line driving circuit 23 switches the voltage of the signal line DTL from Vofs to Vsig.

Signal Writing and μ Correction Period

After finishing the Vth correction dormant period (that is, after completing the Vth correction period), the driving circuit 20 performs the writing of the signal voltage and the μ correction according to the picture signal 20A. Specifically, while the voltage of the signal line DTL is set as Vsig and the voltage of the power line DSL is set as Vcc, the scanning line driving circuit 24 increases the voltage of the scanning line WSL from Voff to Von according to the control signal 21A (T5) and makes the gate of the driving transistor Tr1 connect to the signal line DTL. Then, the gate voltage Vg of the driving transistor Tr1 becomes the voltage Vsig of the signal line DTL. At this time, the anode voltage of the organic EL element 13 is still smaller than the threshold voltage Ve1 of the organic EL element 13 at this stage and the organic EL element 13 is cut-off. Therefore, since the current Ids flows into the element capacity Coled of the organic EL element 13 and the element capacity Coled is charged, the source voltage Vs rises by only ΔVs and eventually, the potential difference Vgs becomes Vsig+Vth−ΔVs. In this way, the writing and the μ correction are performed at the same time. Here, the bigger the mobility μ of the driving transistor Tr1 is, the bigger ΔVs is and therefore, it is possible to remove the variability of the mobility μ for each pixel 11 by making the potential difference Vgs smaller by only ΔV before the emission of light.

Emission of Light

At last, the scanning line driving circuit 24 decreases the voltage of the scanning line WSL from Von to Voff according to the control signal 21A (T6). Then, the gate of the driving transistor Tr1 becomes floating, the current Ids flows into between the drain and the source of the driving transistor Tr1 and the source voltage Vs rises. As a result, the voltage which is greater than or equal to the threshold voltage Ve1 is applied to the organic EL element 13 and the organic EL element 13 emits light with the desired luminance.

Next, an example of the scanning of the Vth correction and the signal writing and μ correction in the display device 1 of the embodiment will be described with reference to FIG. 8 and FIG. 9. Here, FIG. 9 represents an example of the scanning of the Vth correction and the signal writing and μ correction in two units which are adjacent to each other in the column direction.

Here, below, description will be given by separating all pixels 11 within one unit as groups for each connected scanning line WSL. In the embodiment, all pixels 11G and all pixels 11B within one unit are set as one group and all pixels 11R within one unit are set as one group. So, below, all pixels 11G and all pixels 11B within a unit in which the scanning lines WSL (n) and WSL (n+1) have been connected, are set as the first group and all pixels 11R within the unit are set as the second group. In addition, all pixels 11G and all pixels 11B within a unit in which the scanning lines WSL (n+2) and WSL (n+3) have been connected, are set as the third group and all pixels 11R within the unit are set as the fourth group.

After performing the Vth correction with respect to all groups (the first and the second group) within one unit at the same period, the driving circuit 20 performs the writing of the signal voltage for each group with respect to all groups (the first and the second group) within the unit in order. At this time, after performing the signal writing with respect to the first group of the pixels 11 connected to the scanning line WSL (n) of the highest row, the driving circuit 20 performs the signal writing with respect to the second group of the pixels 11 connected to the scanning line WSL (n+1) of the bottom row.

After this, after performing the Vth correction with respect to all groups (the third and the fourth group) within the next unit at the same period, the driving circuit 20 performs the writing of the signal voltage for each group with respect to all groups (the third and the fourth group) within the unit in order. At this time, after performing the signal writing with respect to the first group of the pixels 11 connected to the scanning line WSL (n+2) of the highest row, the driving circuit 20 performs the signal writing with respect to the second group of the pixels 11 connected to the scanning line WSL (n+3) of the bottom row in the same way as described above.

At this time, after performing the Vth correction within one horizontal period (1H) with respect to one unit, the driving circuit 20 performs the signal writing within the next horizontal period (1H). That is, the driving circuit 20 continuously uses two horizontal periods (2H) with respect to one unit to perform the Vth correction and the signal writing.

In addition, when performing the signal writing for each group, the driving circuit 20 performs the signal writing at the same time with respect to all pixels 11 included in the group. Specifically, when the scanning line WSL (n) has been selected, the driving circuit 20 output the voltage V (n) described above with respect to each signal line DTL. That is, when the scanning line WSL (n) has been selected, the driving circuit 20 outputs Vsig (Vsig (n, m) and Vsig (n, m+2)) of the n-pixel row with respect to even-numbers of the signal lines DTL (DTL (m) and DTL (m+2)) and outputs the voltage Vsig (Vsig (n+1, m+1) and Vsig (n+1, m+3)) corresponding to the n+1-pixel row with respect to odd-numbers of the signal lines DTL (m+1) and DTL (m+3) at the same time. In addition, when the scanning line WSL (n+1) has been selected, the driving circuit 20 outputs Vsig (Vsig (n+1, m) and Vsig (n+1, m+2)) of the n+1-pixel row with respect to even-numbers of the signal lines DTL (DTL (m) and DTL (m+2)) and outputs the voltage Vsig (Vsig (n, m+1) and Vsig (n, m+3)) corresponding to the n-pixel row with respect to odd-numbers of the signal lines DTL (m+1) and DTL (m+3) at the same time.

As a result of doing so, in each pixel 11G of the same luminescent color, since the periods from the finish of the Vth correction to the start of the μ correction (the waiting time Δt1, as it is called) correspond, the waiting times Δt1 in a plurality of pixels 11G correspond for each pixel row. Here, in the embodiment, the waiting times Δt2 of each pixel 11B are equal to the waiting times Δt1 of each pixel 11G. Therefore, since the waiting times Δt2 also correspond in each pixel 11B of the same luminescent color, the waiting times Δt2 in a plurality of pixels 11B correspond for each pixel row. In addition, since the waiting times Δt3 are also correspondent in each pixel 11R of the same luminescent color, the waiting times Δt3 in a plurality of pixels 11R correspond for each pixel row. Here, the waiting times Δt1 and Δt2 of the pixels 11G and 11B and the waiting times Δt3 of the pixel 11R are different from each other and however, this slightly affects only the color reproductivity and dose not affect the color shading.

In addition, after performing the writing of the signal voltage into each pixel 11 in one unit with respect to pixels 11 (for example, pixels 11G and 11B) of one kind or a plurality of kinds of luminescent colors including the pixels 11 (for example, pixel 11G) of the luminescent color in which the distance between the single color coordinates and the mixed color coordinates is relatively the shortest, the driving circuit 20 performs the writing of the signal voltage with respect to pixels 11 (for example, pixel 11R) of one kind or a plurality of kinds of luminescent colors in which the kinds of luminescent colors are different from these pixels 11. In so doing, in sequence of the signal writing within one unit, it is possible to perform the signal writing into the pixels 11 of the luminescent color in which the distance between the single color coordinates and the mixed color coordinates is relatively the shortest first.

Effect

Next, description of the effects in the display device 1 of the embodiment will be given.

Figure 10:
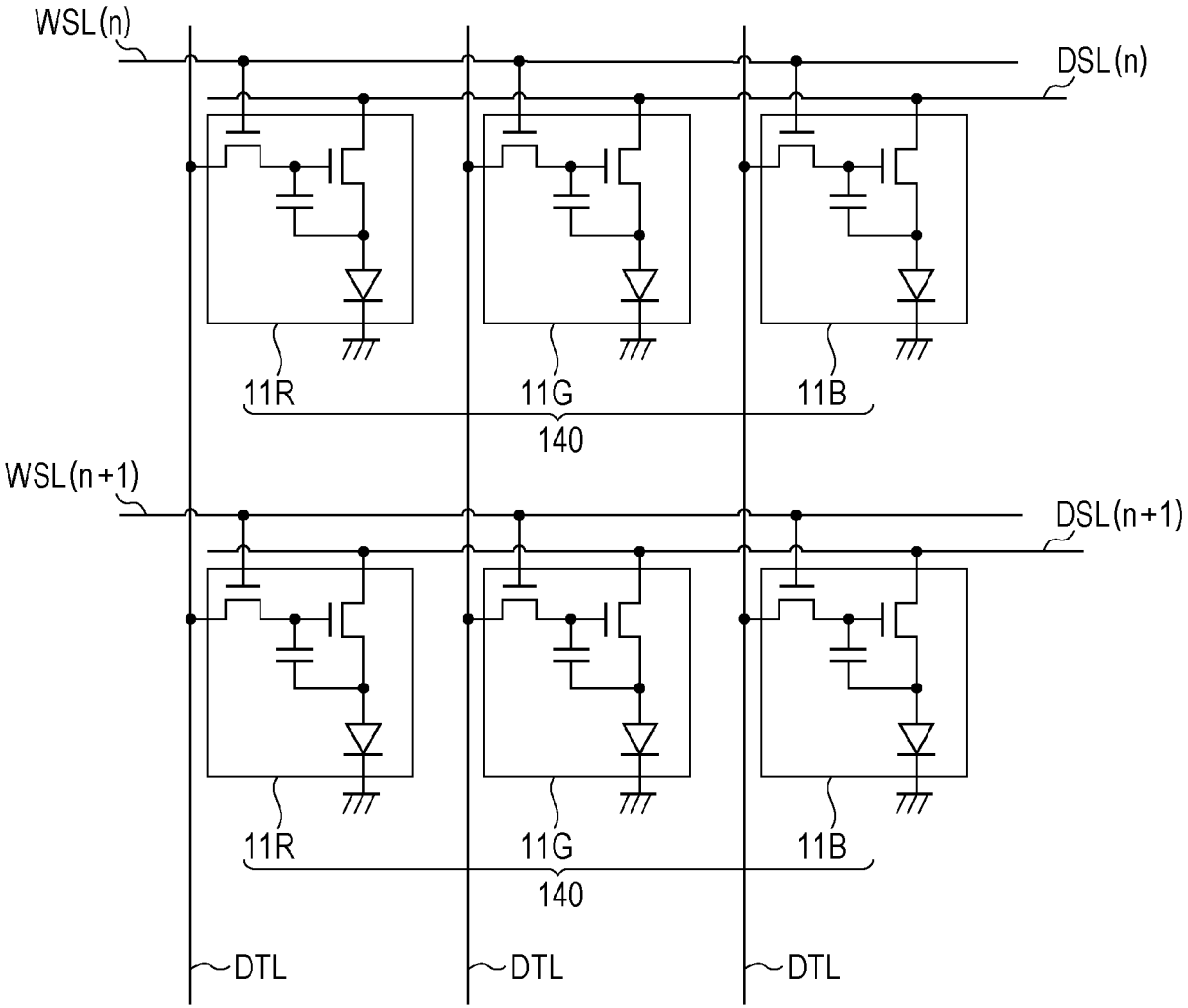
FIG. 10 is a view representing an example of a wiring connection in a display panel in the related art.
Figure 11:
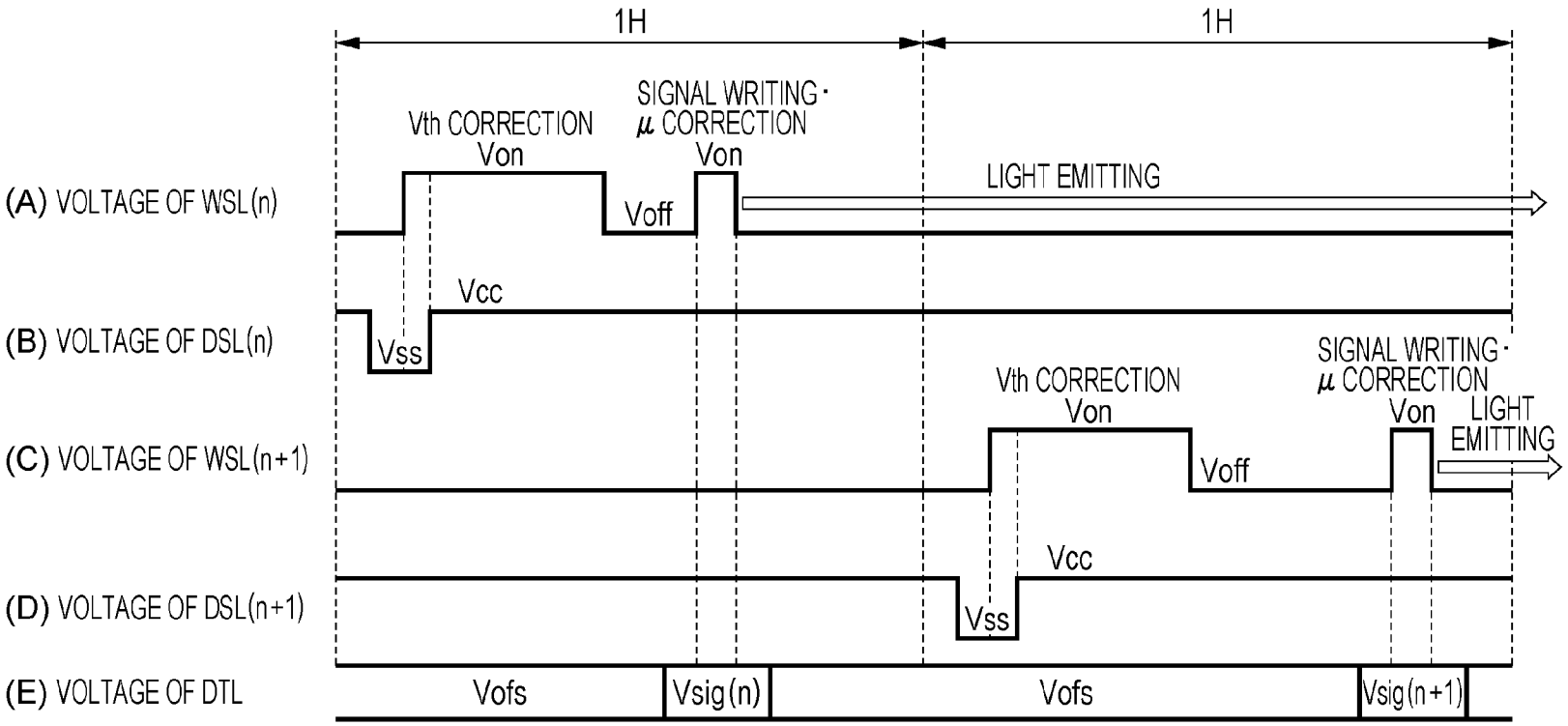
FIG. 11 is a wave form chart for illustrating an example of an action of a display device including a display panel in FIG. 10.
Figure 12:
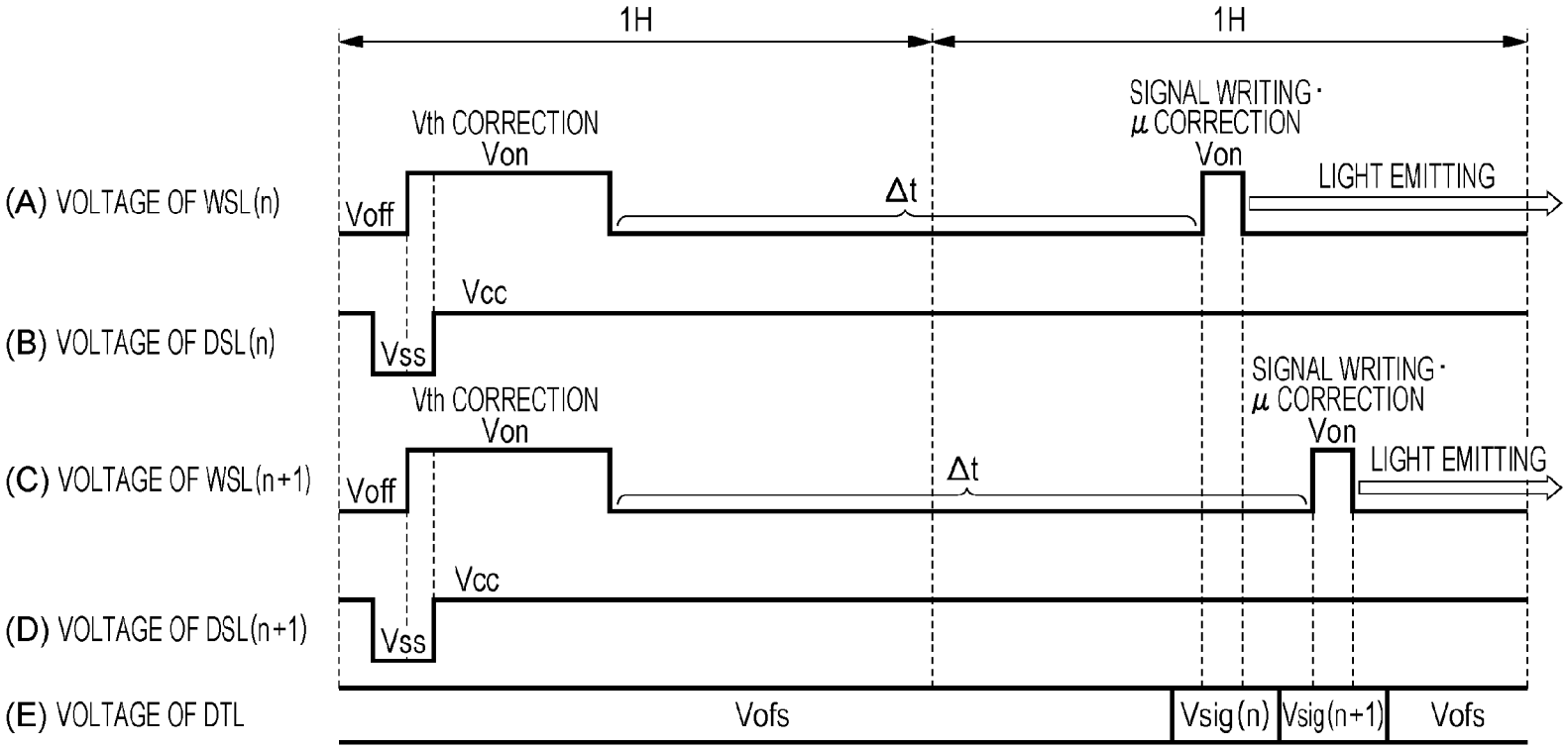
FIG. 12 is a wave form chart for illustrating another example of an action of a display device including a display panel in FIG. 10.

FIG. 10 represents an example of an arrangement of a pixel which generally is used in the related art. In the related art, each pixel of 11R, 11G and 11B included in a display pixel 140 is connected to the common scanning line WSL (n) and the power line DSL (n). In a case of being such an arrangement of a pixel, for example, when the Vth correction and the signal writing are performed for each 1H period, it was difficult to shorten a 1H period and shorten a scanning period per 1F (that is, to set as a high speed driving) as shown in FIG. 11. Therefore, for example, after performing the Vth correction with two lines together within the common 1H period, the signal writing is performed with each line within the next 1H period as shown in FIG. 12. This driving method is suited for a high speed driving due to the Vth correction being bundled. However, the waiting times Δt from the finish of the Vth correction to the start of the signal writing are different for each line. Therefore, even though the signal voltage of the same gradation is applied to the gate of the driving transistor of each line, the light emitting luminance becomes different for each line, and therefore, there was a problem in which the luminance unevenness occurred.

On the other hand, in the embodiment, each scanning line WSL used for selecting each pixel 11 is connected to a plurality of pixels 11 of the same luminescent color within one unit. In addition, each power line DSL used for supplying each pixel 11 with the driving current is connected to all pixels 11 within one unit. In so doing, after performing the Vth correction with respect to all groups within one unit at the same period, it is possible to perform the writing of the signal voltage for each group with respect to all groups within one unit as described above. As a result, in each pixel 11 of the same luminescent color, since the waiting times from the finish of the Vth correction to the start of the μ correction correspond, the waiting times in the pixel 11 of the same luminescent color correspond for each line. Therefore, it is possible to decrease the occurrence of the luminance unevenness due to the Vth correction being bundle.

Figure 13:
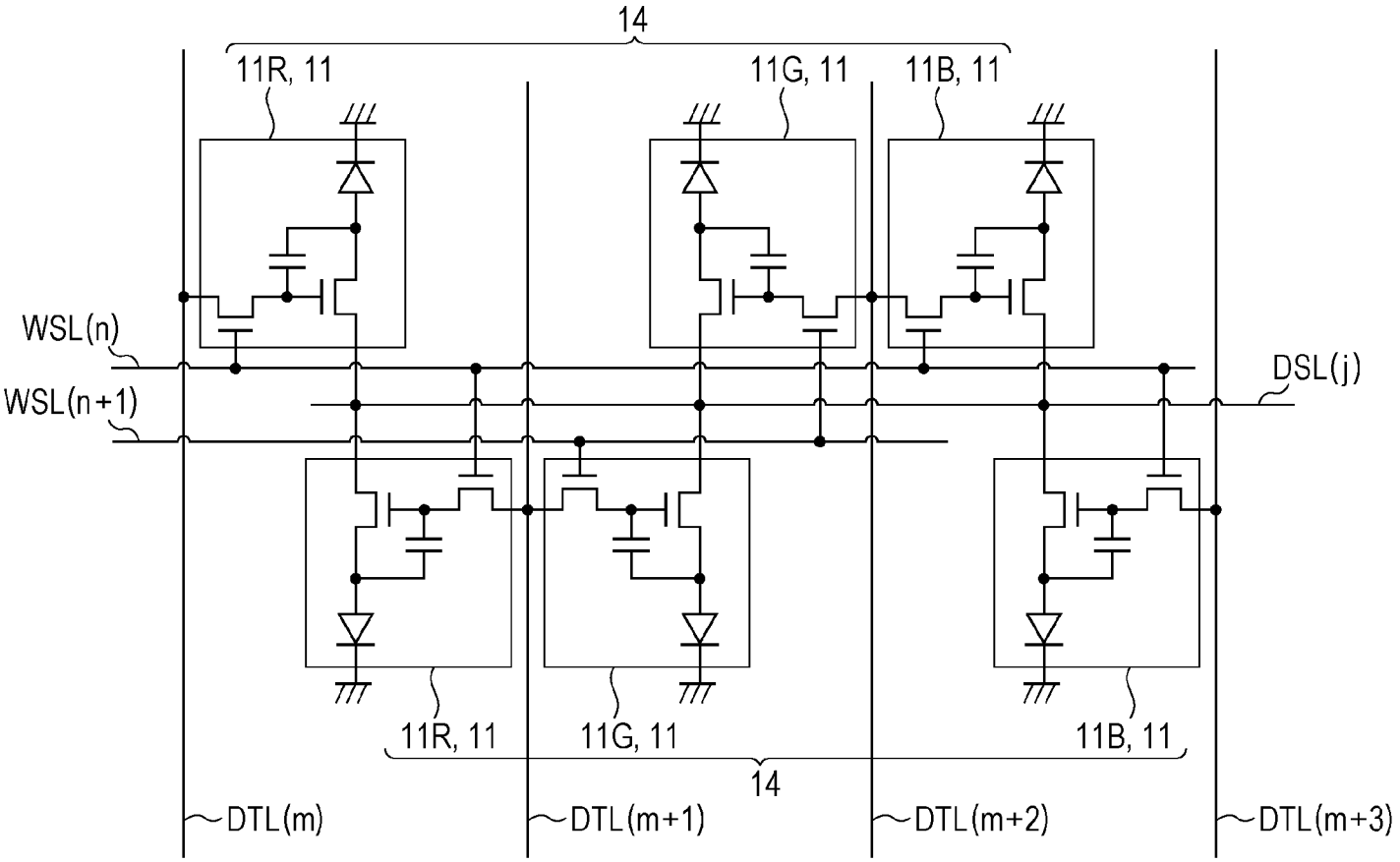
FIG. 13 is a view representing an example of a layout of each pixel in a display panel according to a comparative example.
Figure 14:
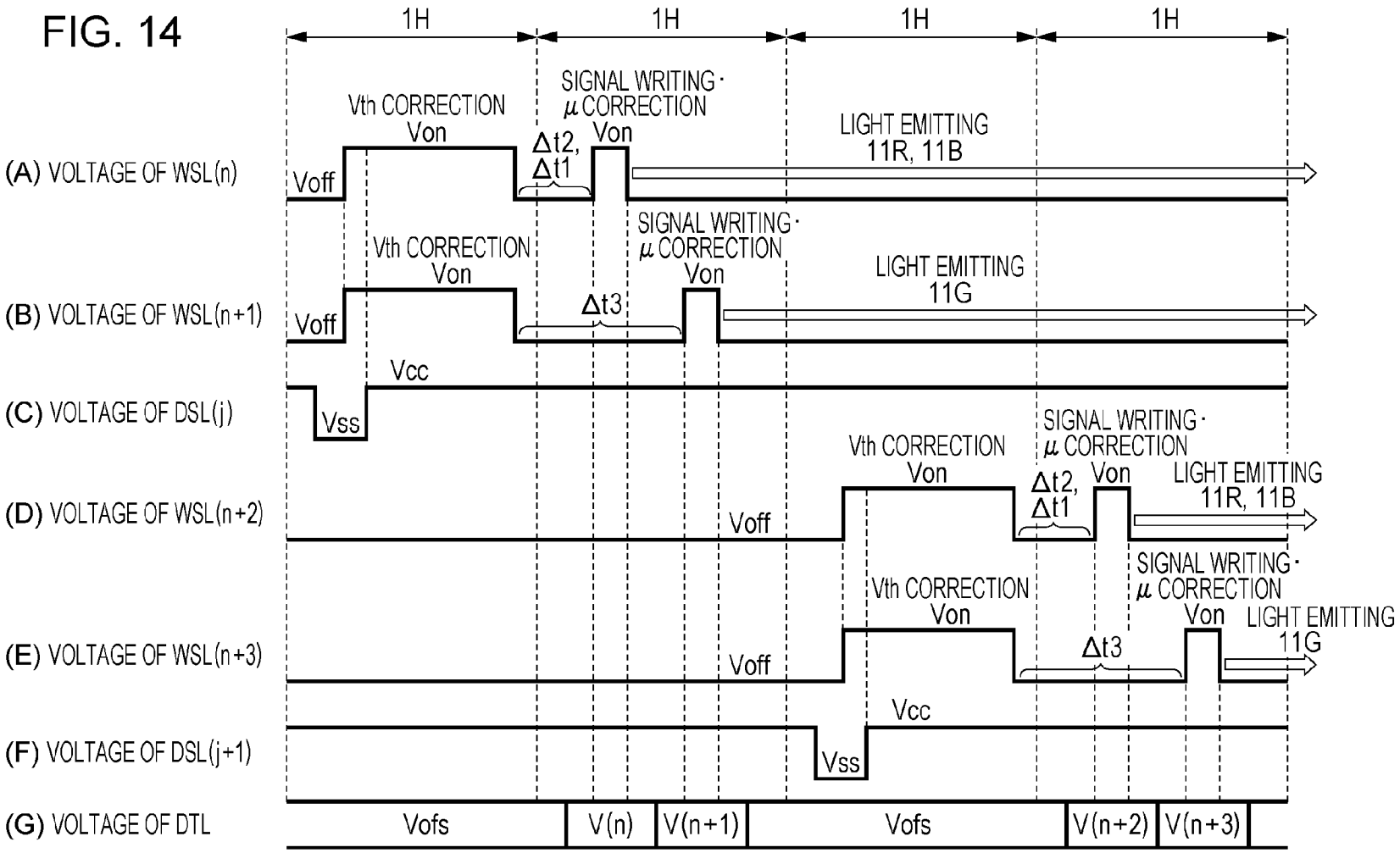
FIG. 14 is a wave form chart for illustrating an example of an action of a display device including a display panel in FIG. 13.

FIG. 13 represents an example of an arrangement of a pixel according to a comparative example. In an arrangement of a pixel shown in FIG. 13, the scanning line (n) of the highest row out of two of the scanning lines WSL (n) and (n+1) assigned for one unit, is connected to the pixels 11 (here, pixels 11R and 11B) of the two kinds of luminescent colors other than the pixel 11 (here, pixel 11G) of the luminescent color in which the distance between the single color coordinates and the mixed color coordinates is relatively the shortest. Therefore, in sequence of the signal writing within one unit, the signal writing into the pixels 11R and 11B is followed by performance of the signal writing into the pixel 11G as shown FIG. 14. In such a sequence of the signal writing, since the timing margin is limited by the signal writing into the pixels 11R and 11B when the signal writing into the pixel 11G is performed, when a 1H period is considerably shorten, the timing margin becomes insufficient. As a result, it is difficult to write the signal voltage of the desired value into the pixel 11 due to transient, and therefore the luminance unevenness and the chromaticity shift occur.

On the other hand, in the embodiment, the scanning line (the scanning line WSL (n)) of the highest row out of k's of the scanning lines WSL assigned for one unit is connected to the pixels 11 (hereinafter, referred as a "specific pixel 11") (for example, pixels 11G and 11B) of one kind or a plurality of kinds of luminescent colors including the pixel 11 (here, pixel 11G) of the luminescent color in which the distance between the single color coordinates and the mixed color coordinates is relatively the shortest. In so doing, in sequence of the signal writing within one unit, the signal writing into the specific pixel 11 is performed first. In such a sequence of the signal writing, since the timing margin is not limited by the signal writing of the latter part when the signal writing into the specific pixel 11 is performed, even though the 1H period is considerably shorten, it is possible to take the adequate timing margin. Therefore, it is possible to decrease the occurrence of the luminance unevenness and the chromaticity shift due to transient when driving with high speed.

2. Modified Example of First Embodiment

Hereinafter, a modified example of the display device 1 in the embodiment described above will be described. Here, below, the same symbols are given with respect to constituent elements common with the display device 1 in the embodiment described above. In addition, description of constituent elements common with the display device 1 in the embodiment described above will be omitted as appropriate.

Figure 15:
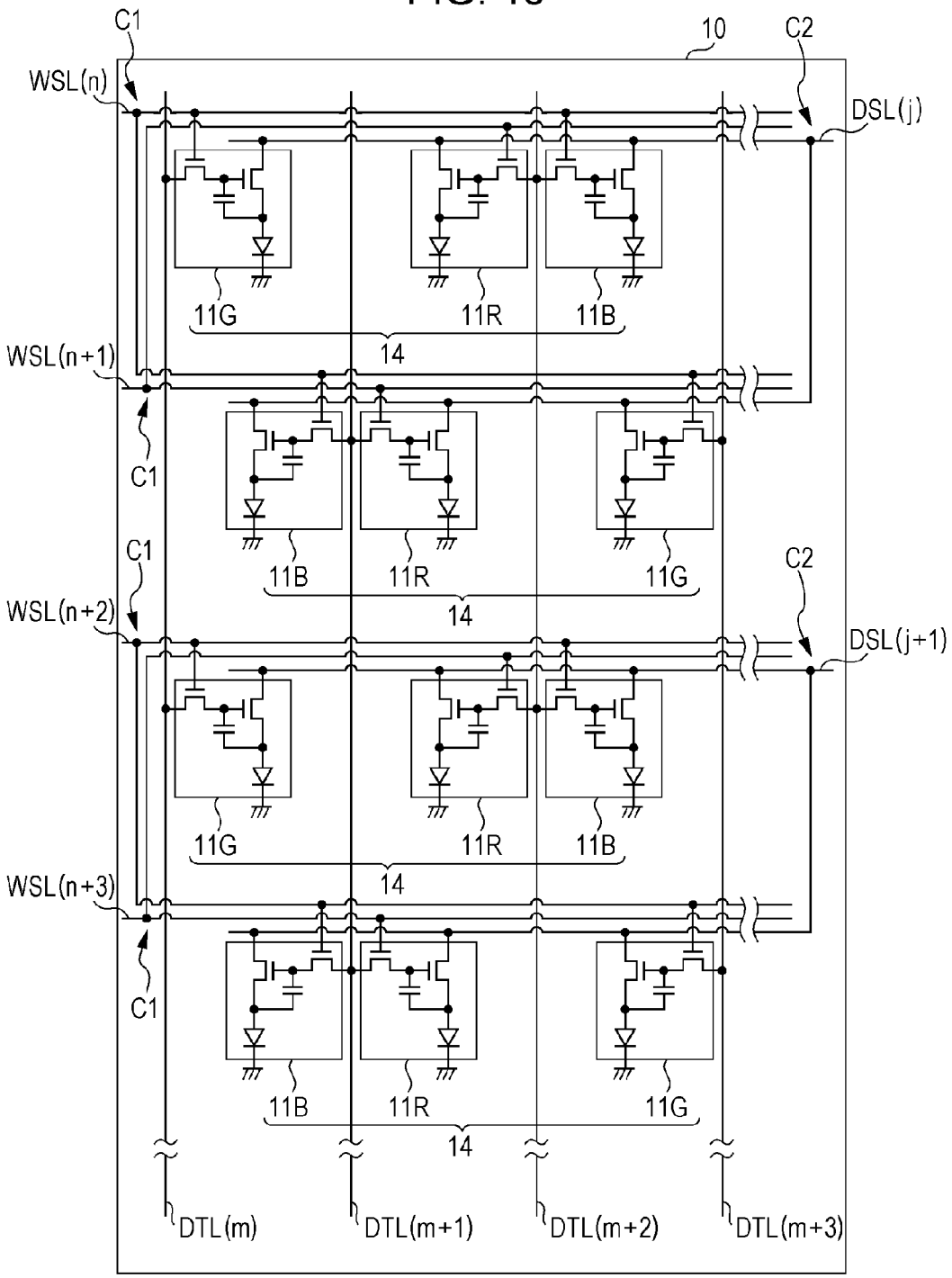
FIG. 15 is a view representing a modified example of a hard wiring configuration of a scanning line and a power line in FIG. 3 and FIG. 4.

In the embodiment described above, a layout of each pixel, for example, may be a layout as shown in FIG. 15. In FIG. 15, each scanning line WSL (WSL (n) to WSL(n+3)) includes the same number of the branch (that is, two branches) as the number of the pixel rows included in one unit. In each scanning line WSL (WSL (n) to WSL(n+3)), each branch is connected to each other within the display panel 10. A connecting point C1 among the branches may be within the display region 10A or may be within the periphery of the display region 10A (the flame region). In addition, when being viewed from the normal direction of the display panel 10, each scanning line WSL is intersected with the other scanning lines WSL within the same unit. In addition, in FIG. 15, each power line DSL (DSL (j) and DSL (j+1)) also includes the same number of the branch (that is, two branches) as the number of the pixel rows included in one unit. In each power line DSL (DSL (j) and DSL (j+1)), each branch is also connected to each other within the display panel 10. A connecting point C2 among the branches may be within the display region 10A or may be within the periphery of the display region 10A (the flame region). In this way, by being provided with the branches in each scanning line WSL and each power line DSL, it is possible to widen the spacing between each scanning line WSL or the spacing between each power line DSL. As a result, a wiring layout is facilitated.

3. Second Embodiment

Configuration

Figure 16:
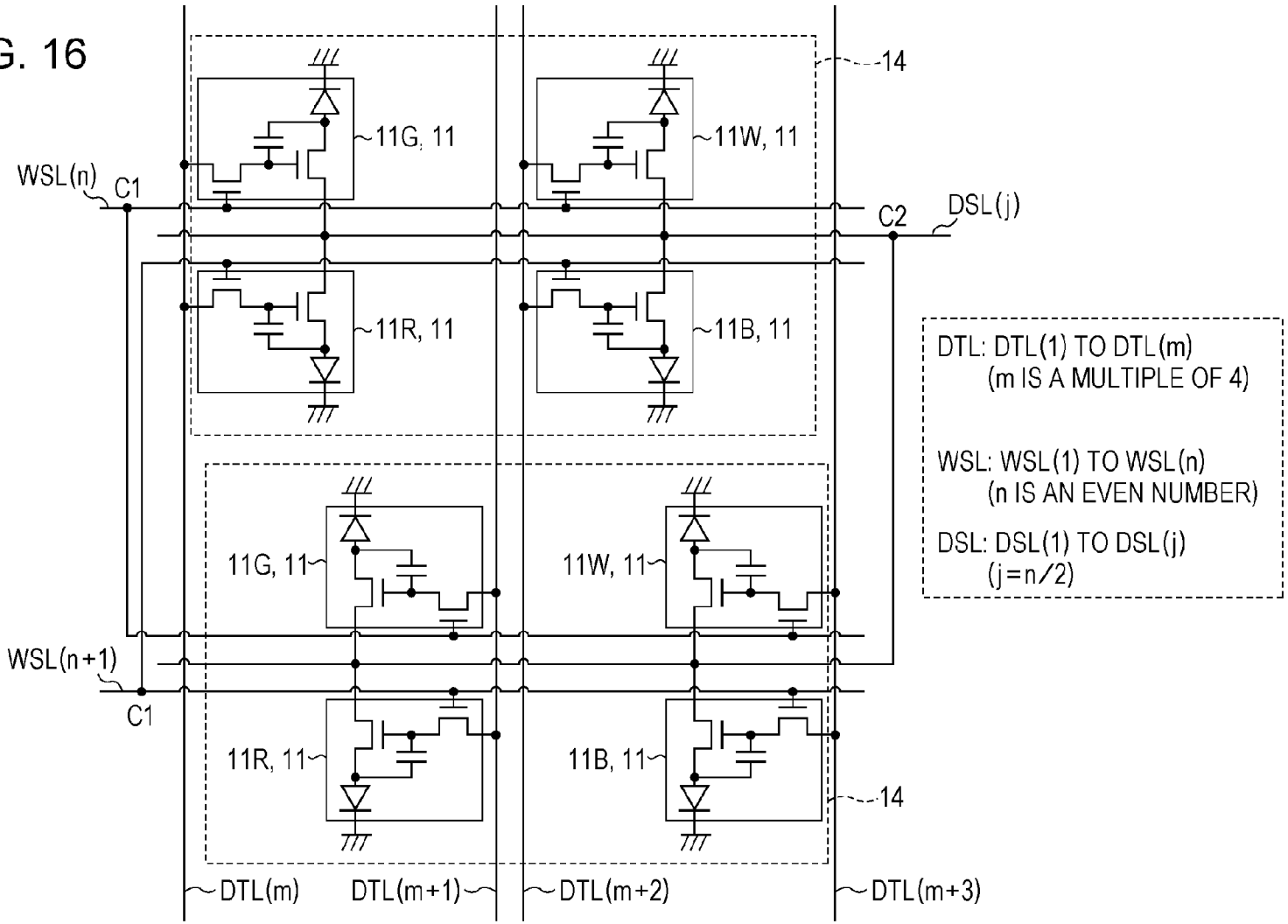
FIG. 16 is a view representing an example of a layout of each pixel in a display device according to the second embodiment of the present technology.
Figure 17:
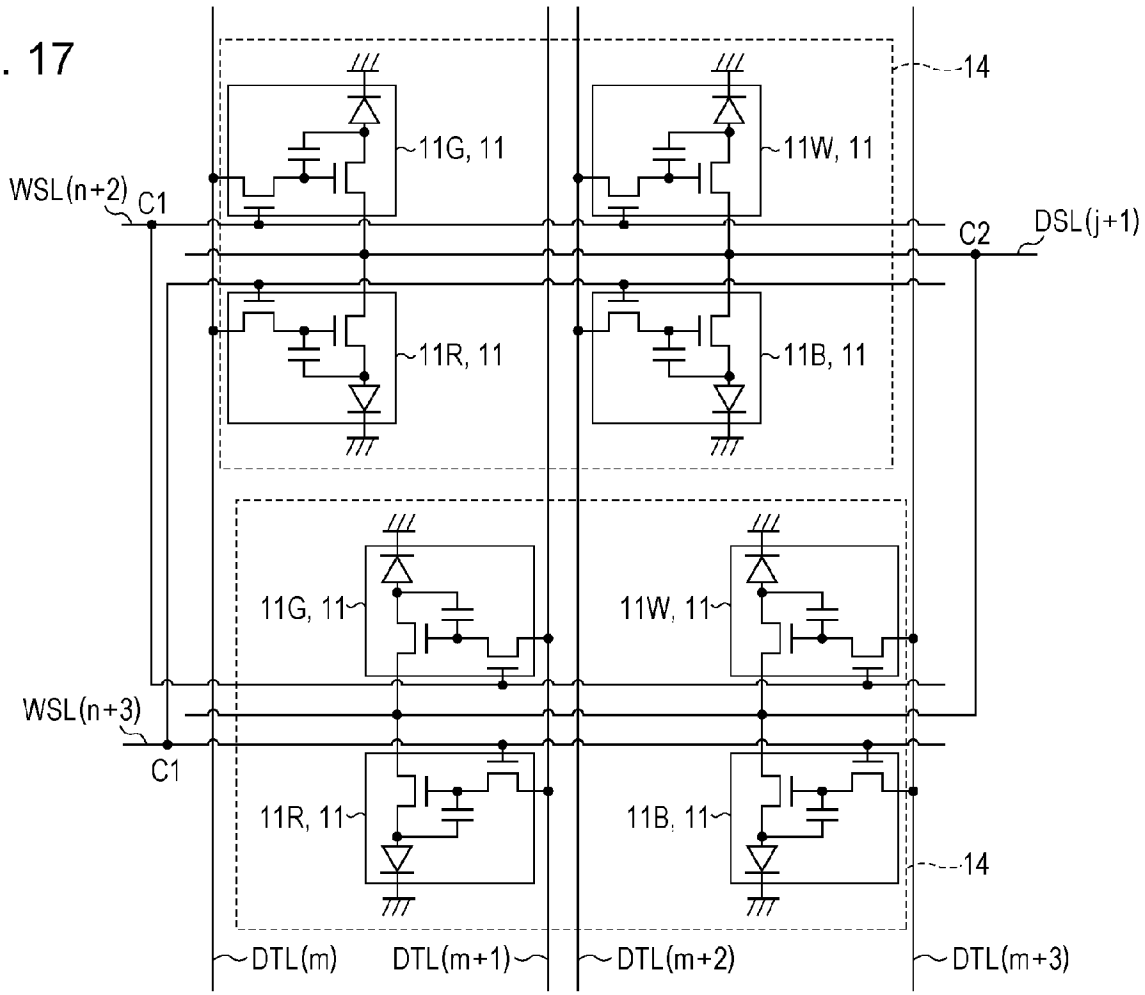
FIG. 17 is a view representing another modified example of a layout of each pixel in FIG. 16.

FIG. 16 represents an example of a layout of each display pixel 14 in the display device 1 according to the second embodiment of the present technology. In the embodiment, the display pixel 14 is configured by four kinds or more of pixels 11 in which the luminescent colors are different from each other. For example, the display pixel 14 is configured by four kinds of pixels 11R, 11G, 11B and 11W in which the luminescent colors are different from each other as shown in FIG. 16 and FIG. 17. FIG. 16 and FIG. 17 represent an example of the configuration of a circuit in two display pixels 14 which are adjacent to each other in the column direction. FIG. 16 represents an example of the configuration of a circuit of each display pixel 14 in the display pixel rows of n-th row ($1 \leq n < N$, N is the total number of the display pixel rows (even numbers)) and n+1-th row. FIG. 17 represents an example of the configuration of a circuit of each display pixel 14 in the display pixel rows of n+2-th row and n+3-th row.

At this time, the number of the kinds of luminescent colors is four. Here, a pixel 11W is the pixel emitting white light and has the same configuration as the other pixels of 11R, 11G and 11B. Here, in the embodiment, a pixel 11Y emitting yellow light may be provided instead of the pixel 11W. In each display pixel 14, four pixels 11 are set as a so-called four-square arrangement and are arranged in a 2×2 matrix. In addition, in each display pixel 14, four pixels 11 are set as the common color arrangement. For example, the pixel 11R is arranged at the upper left in the four-square arrangement, the pixel 11G is arranged at the lower left in the four-square arrangement, the pixel 11B is arranged at the lower right in the four-square arrangement and the pixel 11W is arranged at the upper right in the four-square arrangement as shown in FIG. 16.

In the embodiment, one display pixel row is considered as the standard display pixel 14. When k's (k≥2) of the display pixel rows are set as one unit, a plurality of scanning lines WSL are assigned with k's for one unit. The number of the display pixel rows included in one unit is two or more and equal to or lower than the number of the kinds of luminescent colors. Specifically, when two display pixel rows are set as one unit, a plurality of the scanning lines WSL are assigned with two lines for one unit. Therefore, the number of the display pixel rows included in one unit is two and the number of the scanning lines WSL included in one unit is also two. The total number of the scanning lines WSL is equal to the total number of the display pixel rows and is N. Here, n in FIG. 3 is a positive integer of one or more and N/2 or less and WSL (n) in FIG. 3 means the scanning line WSL of n-th number (n-th row).

Each scanning line WSL is connected to a plurality of pixels 11 of the same luminescent color within one unit. Specifically, in two of the scanning lines WSL (n) and WSL (n+1) included in one unit, the scanning line WSL (n) is connected to a plurality of pixels 11G and a plurality of pixels 11W included in one unit and the scanning line WSL (n+1) is connected to a plurality of pixels 11R and a plurality of pixels 11B included in one unit. In addition, each scanning line WSL is connected to all pixels 11 of the same luminescent color within one unit. Specifically, in two of the scanning lines WSL (n) and WSL (n+1) included in one unit, the scanning line WSL (n) is connected to all pixels 11G and all pixels 11W within one unit and the scanning line WSL (n+1) is connected to all pixels 11R and all pixels 11B within one unit. In two display pixels 14 in which rows are different from each other and are adjacent to each other in the column direction within one unit, the combination of the luminescent colors of the pixels 11 of two kinds of luminescent colors which are shared with the scanning line WSL, is equal to each other.

Each scanning line WSL (WSL (n) to WSL(n+3)) includes the same number of the branches (that is, two branches (the first wiring and the second wiring)) as the number of the subpixel rows included in one display pixel row. Each of the first wirings is assigned with one wiring with respect to the subpixel row of the upper row in each display pixel row within one unit. Each of the first wirings is connected to a plurality of pixels 11 of the same luminescent color within one unit. Each of the second wirings is assigned with one wiring with respect to the subpixel row of the lower row the in each display pixel row within one unit. Each of the second wirings is connected to a plurality of pixels 11 of the luminescent color which is different form the luminescent color of the pixel 11 connected to the first wiring and the same luminescent color within one unit. In each scanning line WSL (WSL (n) to WSL (n+3)), each branch is connected to each other within the display panel 10. A connecting point C1 among the branches may be within the display region 10A or may be within the periphery of the display region 10A (the flame region). In addition, when being viewed from the normal direction of the display panel 10, each scanning line WSL is intersected with the other scanning lines WSL within the same unit. The branches of each scanning line WSL cross the center of the four-square arrangement. The gate electrode 14A of the writing transistor Tr2 is connected to the branch of the scanning line WSL.

A plurality of power lines DSL are assigned with one line for one unit. Therefore, the number of the power lines DSL included in one unit is one. The total number of the power lines DSL is equivalent to the half of the total number of the display pixel rows and is J (=N/2). Here, j in FIG. 16 is a positive integer of one or more and N/2 or less and DSL (j) in FIG. 16 means the power line DSL of j-th number. Each power line DSL is connected to all pixels 11 within one unit. Specifically, one power line DSL included in one unit is connected to all pixels 11 (11R, 11G, 11B and 11W) included in one unit.

In FIG. 16 and FIG. 17, each power line DSL (DSL (j) and DSL (j+1)) includes the same number of branches (that is, two branches) as the number of the display pixel rows included in one unit. In each power line DSL (DSL (j) and DSL (j+1)), each branch is also connected to each other within the display panel 10. A connecting point C2 among the branches may be within the display region 10A or may be within the periphery of the display region 10A (the flame region). In this way, by being provided with the branches in each scanning line WSL and each power line DSL, it is possible to widen the spacing between each scanning line WSL or the spacing between each power line DSL. As a result, a wiring layout is facilitated. The branches of each power line DSL cross the center of the four-square arrangement.

A plurality of signal lines DTL are assigned with two lines for the display pixel 14 in each display pixel row. In two signal lines DTL assigned for each display pixel 14 in each display pixel row, one signal line DTL is connected to the pixels 11 of two kinds of luminescent colors which are not shared with the scanning line WSL and the other signal line DTL is connected to the pixels 11 of two remaining kinds of luminescent colors. Hereinafter, with focusing on two display pixels 14 which are adjacent to each other in the column direction out of a plurality of display pixels 14 included in the display pixel rows of n-th row and n+1-th row, an embodiment of the connection described above will be described. Here, two display pixels 14 described above are equivalent to two display pixels 14 in which the display pixel rows are different from each other and are adjacent to each other in the column direction within one unit.

In the display pixel 14 included in the display pixel row of n-th row out of two display pixels 14 described above, two of the signal lines DTL (m) and DTL (m+2) are assigned. In addition, in the display pixel 14 included in the display pixel row of n+1-th row out of two display pixels 14 described above, two of the signal lines DTL (m+2) and DTL (m+3) are assigned. That is, in two display pixels 14 in which the display pixel rows are different from each other and are adjacent to each other in the column direction within one unit, two of the signal lines DTL (m) and DTL (m+2) of an even number of row are assigned with respect to one display pixel 14 and two of the signal lines DTL (m+1) and DTL (m+3) of an odd number of rows are assigned with respect to the other display pixel 14. In so doing, the total number of the signal lines DTL is suppressed to a minimum.

A plurality of signal lines DTL are assigned with four lines for two display pixels 14 which are adjacent to each other in the column direction. Therefore, the total number of the signal lines DTL is M (M is a multiple of 4). In FIG. 16, m is a positive integer of one or more and equal to or lower than M−4 and is the number which is equivalent to (a multiple of 4+1) in a case of being other than 1. Therefore, DTL (m) in FIG. 16 means the signal line DTL of m-th number. In two display pixels 14 which are adjacent to each other in the column direction, for example, four of the signal lines DTL (m), DTL (m+1), DTL (m+2) and DTL (m+3) are assigned. Four of the signal lines DTL (m), DTL (m+1), DTL (m+2) and DTL (m+3) are arranged in line in this order in the row direction. In each display pixel 14, two pixels 11 at the left side out of four pixels 11 are sandwiched between the signal line DTL (m) and the signal line DTL (m+1) from the row direction. In addition, in each display pixel 14, two pixels 11 at the right side out of four pixels 11 are sandwiched between the signal line DTL (m+2) and the signal line DTL (m+3) from the row direction.

In addition, in two display pixels 14 in which the display pixel rows are different from each other and are adjacent to each other in the column direction within one unit, two pixels 11 in which the luminescent colors are equal to each other are arranged between the common two signal lines DTL. Specifically, in two display pixels 14 in which the display pixel rows are different from each other and are adjacent to each other in the column direction within one unit, two pixels 11R are arranged between two of the signal lines DTL (m) and DTL (m+1). In the same way, in two display pixels 14 in which the display pixel rows are different from each other and are adjacent to each other within one unit, two pixels 11G are arranged between two of the signal lines DTL (m) and DTL (m+1). In addition, in two display pixels 14 in which the display pixel rows are different from each other and are adjacent to each other within one unit, two pixels 11B are arranged between two of the signal lines DTL (m+2) and DTL (m+3). In addition, in two display pixels 14 in which the display pixel rows are different from each other and are adjacent to each other within one unit, two pixels 11W are arranged between two of the signal lines DTL (m+2) and DTL (m+3).

Two of the signal lines DTL (m) and DTL (m+2) described above are respectively connected to the pixels 11 of two kinds of luminescent colors in which the scanning lines WSL are not shared to each other. Specifically, the signal line DTL (m) is connected to the pixels 11R and 11G of two kinds of luminescent colors in which the scanning lines WSL are not shared to each other and the signal line DTL (m+2) is connected to the pixels 11B and 11W of two kinds of luminescent colors in which the scanning lines WSL are not shared to each other. In addition, the display pixel 14 included in the pixel row of n+1-th row out of two display pixels 14 described above is assigned with two of the signal lines DTL (m+1) and DTL (m+3). Two of the signal lines DTL (m+1) and DTL (m+3) are respectively connected to the pixels 11 of two kinds of luminescent colors in which the scanning lines WSL are not shared to each other. Specifically, the signal line DTL (m+1) is connected to the pixels 11R and 11G of two kinds of luminescent colors in which the scanning lines WSL are not shared to each other and the signal line DTL (m+3) is connected to the pixels 11B and 11W of two remaining kinds of luminescent colors.

In two display pixels 14 in which the display pixel rows are different from each other and are adjacent to each other within one unit, the combination of the luminescent colors of the pixels 11 of two kinds of luminescent colors, which are shared with the scanning line WSL, is equal to each other. In addition, in two display pixels 14 in which the display pixel rows are different from each other and are adjacent to each other within one unit, the arrangement of the luminescent color is also equal to each other.

Kinds of Luminescent Colors

Next, the combination of k's of the scanning lines WSL assigned for one unit and the kinds of luminescent colors of the pixels 11 included in the display pixel 14 will be described. In addition, the combination of a's of the signal lines DTL assigned for each display pixel 14 in each display pixel row and the kinds of luminescent colors of the pixels 11 included in the display pixel 14 will be described.

Figure 18:
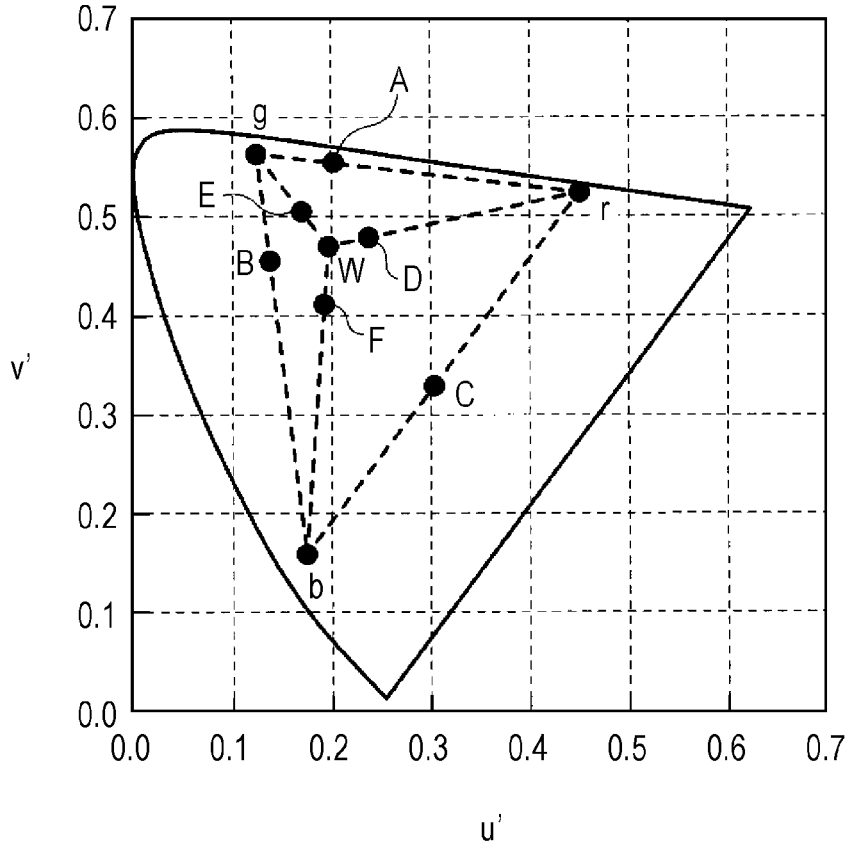
FIG. 18 is an u'v' chromaticity diagram in which the coordinates of RGBW and intermediate colors thereof are plotted.

FIG. 18 is an u'v' chromaticity diagram in which the coordinates (the single color coordinates) of the chromaticity of the luminescent color of four pixels 11 included in the display pixel 14 are plotted again using the formulae 1, 2 and 3 described above. A to D in FIG. 18 are plots of the coordinates (the mixed color coordinates) in an u'v' chromaticity diagram of four mixed colors capable of being formed by using two arbitrary colors out of four luminescent colors included in one display pixel 14. Specifically, A in FIG. 18 is a plot of the coordinates in an u'v' chromaticity diagram of the mixed colors of the luminescent color (red) of the pixel 11R and the luminescent color (green) of the pixel 11G. B in FIG. 18 is a plot of the coordinates in an u'v' chromaticity diagram of the mixed colors of the luminescent color (green) of the pixel 11G and the luminescent color (blue) of the pixel 11B. C in FIG. 18 is a plot of the coordinates in an u'v' chromaticity diagram of the mixed colors of the luminescent color (blue) of the pixel 11B and the luminescent color (red) of the pixel 11R. D in FIG. 18 is a plot of the coordinates in an u'v' chromaticity diagram of the mixed colors of the luminescent color (red) of the pixel 11R and the luminescent color (white) of the pixel 11W. E in FIG. 18 is a plot of the coordinates in an u'v' chromaticity diagram of the mixed colors of the luminescent color (green) of the pixel 11G and the luminescent color (white) of the pixel 11W. F in FIG. 18 is a plot of the coordinates in an u'v' chromaticity diagram of the mixed colors of the luminescent color (blue) of the pixel 11B and the luminescent color (white) of the pixel 11W.

As described above, each scanning line WSL is connected to a plurality of pixels 11 of the same luminescent color within one unit. At this time, in k's of the scanning lines WSL assigned for one unit, the scanning line WSL of the highest row (the first scanning line) is connected to the pixels 11 of one kind or a plurality of kinds of luminescent colors including the pixel 11 of the luminescent color in which the distance between the single color coordinates and the mixed color coordinates is relatively the shortest (hereinafter, referred to as a "specific pixel 11"). In k's of the scanning lines WSL assigned for one unit, the scanning line WSL of the highest row (the first scanning line) is preferably connected to the pixels 11 of a plurality of kinds of luminescent colors including the specific pixel 11 and the pixel 11 of the luminescent color in which the distance between the single color coordinates and the mixed color coordinates is relatively the second shortest.

In the embodiment, it is understood that the pixel 11 of the luminescent color in which the distance between the single color coordinates and the mixed color coordinates is relatively the shortest is the pixel 11W according to FIG. 18. In addition, it is understood that the pixel 11 of the luminescent color in which the distance between the single color coordinates and the mixed color coordinates is relatively the second shortest is the pixel 11G according to FIG. 18. Therefore, for example, in two scanning lines WSL assigned for one unit, the scanning line WSL (the first scanning line) of the highest row is connected to the pixels 11 of two kinds of luminescent colors including the pixel 11W in which the distance between the single color coordinates and the mixed color coordinates is relatively the shortest. Here, in two scanning lines WSL assigned for one unit, the scanning line WSL (the first scanning line) of the highest row is preferably connected to the pixels 11 of two kinds of luminescent colors including the pixel 11W in which the distance between the single color coordinates and the mixed color coordinates is relatively the shortest and the pixel 11G which is relatively the second shortest. The scanning line WSL of the latter row is connected to the pixels 11R and 11B of two kinds of luminescent colors.

In addition, as described above, in a's (2≤a<(the total number of the subpixels in one pixel)) of the signal lines DTL assigned for each display pixel 14 in each display pixel row, one signal line DTL (the first signal line) is connected to the pixels 11 of two kinds of luminescent colors which are not shared with the scanning line WSL in one display pixel 14. In addition, in a's (2≤a<(the total number of the subpixels in one pixel)) of the signal lines DTL assigned for each display pixel 14 in each display pixel row, another one signal line DTL (the second signal line) is connected to the pixels 11 of two kinds of luminescent colors which are not shared with the scanning line WSL in one display pixel 14.

In the embodiment, in each display pixel row, two signal lines DTL are assigned for each display pixel 14 and, in addition, the number of the kinds of luminescent colors included in one display pixel 14 is four. Therefore, one signal line DTL (the first signal line) is connected to the pixels 11 of two kinds of luminescent colors other than the pixel 11 of the luminescent color in which the distance between the single color coordinates and the mixed color coordinates is relatively the shortest. Furthermore, one signal line DTL (the first signal line) is preferably connected to the subpixels of two kinds of luminescent colors including the subpixel of the luminescent color in which the distance between the single color coordinates and the mixed color coordinates is relatively the second shortest. Here, one signal line DTL (the first signal line) is connected to the pixels 11 of two kinds of luminescent colors which are not connected to the other signal line DTL (the second signal line). On the other hand, the other signal line DTL (the second signal line) is connected to pixels 11 of two kinds of luminescent colors including the pixel 11 of the luminescent color in which the distance between the single color coordinates and the mixed color coordinates is relatively the shortest.

In the embodiment, it is understood that the pixel 11 of the luminescent color in which the distance between the single color coordinates and the mixed color coordinates is relatively the shortest is the pixel 11W according to FIG. 18. Furthermore, it is understood that the pixel 11 of the luminescent color in which the distance between the single color coordinates and the mixed color coordinates is relatively the second shortest is the pixel 11G according to FIG. 18. Therefore, one signal line DTL (the first signal line) is connected to the pixel 11 of two kinds of luminescent colors other than the pixel 11W. In addition, one signal line DTL (the first signal line) is preferably connected to the pixel 11 of two kinds of luminescent colors including the pixel 11G. On the other hand, the other signal line DTL (the second signal line) is connected to the pixel 11 of two kinds of luminescent colors including the pixel 11W. In addition, the other signal line DTL (the second signal line) is preferably connected to the pixels 11 of two kinds of luminescent colors including the pixel 11W and, the pixel 11B or the pixel 11R.

Driving Circuit 20

Hereinafter, the points which are different from the embodiment described above will be mainly described.

The signal line driving circuit 23 outputs a signal voltage V (n) corresponding to the selection of the scanning line WSL (n) and outputs a signal voltage V (n+1) corresponding to the selection of the scanning line WSL (n+1). In the same way, the signal line driving circuit 23 outputs a signal voltage V (n+2) corresponding to the selection of the scanning line WSL (n+2) and outputs a signal voltage V (n+3) corresponding to the selection of the scanning line WSL (n+3). Here, the scanning line driving circuit 24 selects the scanning lines WSL in the order of WSL (n+1), WSL (n), WSL (n+3) and WSL (n+2) on the occasion of the writing of the signal voltage. Therefore, the signal line driving circuit 23 outputs the signal voltage Vsig in the order of V (n+1), V (n), V (n+3) and V (n+2) on the occasion of the writing of the signal voltage.

The signal line driving circuit 23, for example, supplies the voltages Vsig (Vsig (n, m) and Vsig (n, m+2)) corresponding to the n display pixel row with respect to a plurality of pixels 11 which belong to the n display pixel row out of a plurality of pixels 11 selected at the same time by the scanning line driving circuit 24 through even-numbers of the signal lines DTL (m) and DTL (m+2), as shown in FIG. 7. In addition, the signal line driving circuit 23 supplies the voltages Vsig (Vsig(n+1, m+1) and Vsig (n+1, m+3)) corresponding to the n+1 display pixel row with respect to a plurality of pixels 11 which belong to the n+1 display pixel row out of a plurality of pixels 11 selected at the same time by the scanning line driving circuit 24 through odd-number of the signal lines DTL (m+1) and DTL (m+3).

That is, when the scanning line WSL (n) has been selected on the occasion of the signal writing, the signal line driving circuit 23 outputs the voltages Vsig (n, m) and Vsig (n, m+2) corresponding to the n display pixel row with respect to even-numbers of the signal line DTL (m) and DTL (m+2) and outputs the voltages Vsig (n, m+1) and Vsig (n, m+3) corresponding to the n+1 display pixel row with respect to odd-numbers of the signal lines DTL (m+1) and DTL (m+3) at the same time. In addition, when the scanning line WSL (n+1) is selected on the occasion of the signal writing, the signal line driving circuit 23 outputs the voltages Vsig (n+1, m) and Vsig (n+1, m+2) corresponding to the n+1 display pixel row with respect to even-numbers of the signal lines DTL (m) and DTL (m+2) and outputs the voltages Vsig (n, m+1) and Vsig (n, m+3) corresponding to the n display pixel row with respect to odd-numbers of the signal lines DTL (m+1) and DTL (m+3) at the same time. Here, the signal line driving circuit 23 also applies the voltage corresponding to the n+2 pixel row and the n+3 pixel row in the same way as the n pixel row and n+1 pixel row.

Two pixels 11 arranged between even-numbers of the signal line DTL (m) and odd-numbers of the signal line DTL (m+1) out of a plurality of the pixels 11 selected by the scanning line driving circuit 24 at the same time, are the pixels in which the luminescent colors are equal to each other. In the same way, two pixels 11 arranged between even-numbers of the signal line DTL (m+2) and odd-numbers of the signal line DTL (m+3) out of a plurality of pixels 11 selected by the scanning line driving circuit 24 at the same time, are also the pixels in which the luminescent colors are equal to each other. Therefore, when the scanning line WSL (n) has been selected, the signal line driving circuit 23 outputs the voltages Vsig corresponding to the pixels in which the luminescent colors are equal to each other with respect to the signal lines DTL (m) and DTL (m+1) and, outputs the voltages Vsig corresponding to the pixel in which the kinds are different and the luminescent colors are equal to each other with respect to the signal lines DTL (m+2) and DTL (m+3) at the same time. For example, when the scanning line WSL (n) has been selected, the signal line driving circuit 23 outputs the voltages Vsig corresponding to the pixel 11R with respect to the signal line DTL (m) and DTL (m+1) and outputs the voltages Vsig corresponding to the pixel 11W with respect to the signal lines DTL (m+2) and DTL (m+3) at the same time.

Then, the driving circuit 20 collectively performs the Vth correction and the signal writing for each unit. Specifically, after performing the Vth correction and the signal writing in the first unit, the driving circuit 20 performs the Vth correction and the signal writing in the first unit and in the second unit which is adjacent in the column direction. That is, the driving circuit 20 performs a series of actions (the Vth correction and the signal writing) per unit in order.

The scanning line driving circuit 24 selects all scanning lines WSL included in one unit at the same time (or at the same period) on the occasion of the Vth correction. Specifically, the scanning line driving circuit 24 selects two of the scanning lines WSL (n) and WSL (n+1) included in one unit at the same time (or at the same period) on the occasion of the Vth correction. That is, the scanning line driving circuit 24 selects a plurality of pixels 11 (for example, the pixels 11G and 11W) included in subpixel row of the upper row of the n display pixel row, a plurality of pixels 11 (for example, the pixels 11R and 11B) included in subpixel row of the lower row of the n display pixel row, a plurality of pixels 11 (for example, the pixels 11G and 11W) included in subpixel row of the upper row of the n+1 display pixel row and a plurality of pixels 11 (for example, the pixels 11R and 11B) included in subpixel row of the lower row of the n+1 display pixel row at the same time (or at the same period) on the occasion of the Vth correction.

In addition, the scanning line driving circuit 24 selects a plurality of the scanning lines WSL included in one unit in order in the opposite direction of the scanning direction (hereinafter, referred as a "unit scanning direction") of performing a series of actions (the Vth correction and the signal writing) per unit in order on the occasion of the signal writing. The unit scanning direction, for example, is the direction parallel to the direction from the upper end side toward the lower end side of the display panel 10. Therefore, after performing the signal writing into each pixel 11 in one display pixel row with respect to each pixel 11 connected to the second wiring, the scanning line driving circuit 24 performs the signal writing with respect to each pixel 11 connected to the first wiring. Here, the unit scanning direction may be the direction parallel to the direction from the lower end side toward the upper end side of the display panel 10. At this time, although not shown, after performing the signal writing into each pixel 11 in one display pixel row with respect to each pixel 11 connected to the first wiring, the scanning line driving circuit 24 performs with respect to each pixel 11 connected to the second wiring.

The scanning line driving circuit 24 selects two of scanning lines WSL (n) and WSL (n+1) included in one unit in the order of the scanning line WSL (n+1) and the scanning line WSL (n) on the occasion of the signal writing. Therefore, after selecting a plurality of pixels 11 included in the subpixel row of the lower row of the n display pixel row and a plurality of pixels 11 included in the subpixel row of the lower row of the n+1 display pixel row through the scanning line WSL (n+1) at the same time, the scanning line driving circuit 24 selects a plurality of pixels 11 included in the subpixel row of the upper row of the n display pixel row and a plurality of pixels 11 included in the subpixel row of the upper row of the n+1 display pixel row through the scanning line WSL (n) at the same time on the occasion of the signal writing.

The scanning line driving circuit 24, for example, is able to output two kinds of voltages (Von and Voff). Specifically, the scanning line driving circuit 24 supplies the pixel 11 targeted for a driving with two kinds of voltages (Von and Voff) through the scanning line WSL and performs an on-off control of the writing transistor Tr2. Here, Von is the value which is greater than or equal to the on-state voltage of the writing transistor Tr2. Von is the peak value of a writing pulse which is output into "the latter half portion of the Vth correction preparation period", "Vth correction period", "Signal writing and μ correction period" or the like described later from the scanning line driving circuit 24. Voff is the value which is lower than the on-state voltage of the writing transistor Tr2 and is lower than Von. Voff is the peak value of a writing pulse which is output into "the first half portion of the Vth correction preparation period", "light emitting period" or the like described later from the scanning line driving circuit 24.

The power line driving circuit 25, for example, selects a plurality of the power lines DSL for the predetermined unit in order according to the input of the control signal 21A (synchronizing). The power line driving circuit 25, for example, is able to output two kinds of voltages (Vcc and Vss). The power line driving circuit 25 supplies the entire one unit (that is, all pixels 11 included in one unit) including the pixel 11 selected by the scanning line driving circuit 24 with two kinds of voltages (Vcc and Vss) through the power line DSL. Here, Vss is the voltage value which is lower than the voltage (Ve1+Vcath) in which the threshold voltage Ve1 of the organic EL element 13 and the cathode voltage Vcath of the organic EL element 13 are added together. Vcc is the voltage value which is greater than or equal to the voltage (Ve1+Vcath).

Figure 19:
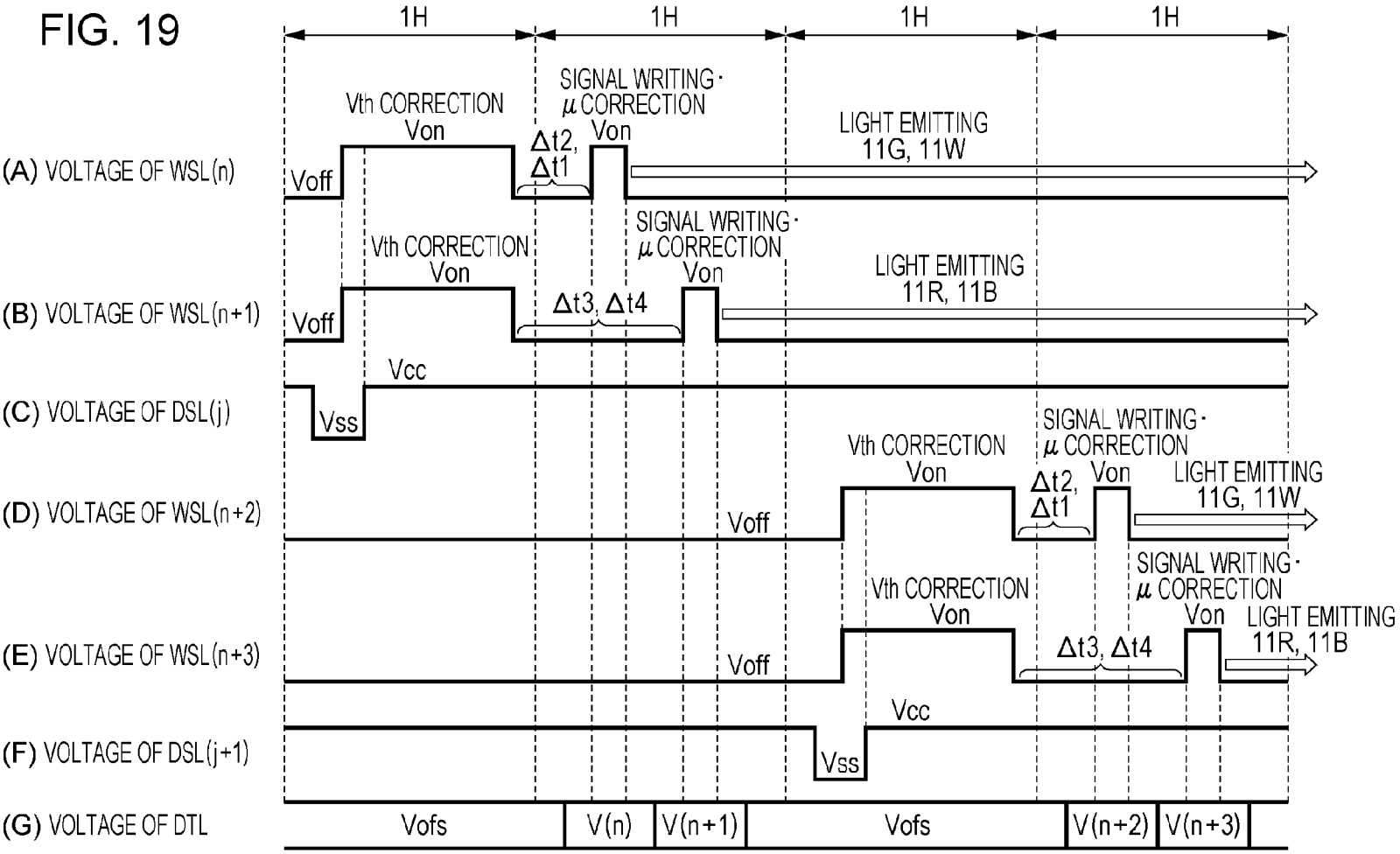
FIG. 19 is a wave form chart for illustrating an example of an action of a display device including a layout in FIG. 16 and FIG. 17.

Next, an example of the scanning of the Vth correction and the signal writing and μ correction in the display device 1 of the modified example will be described with reference to FIG. 8 and FIG. 19. Here, FIG. 19 represents an example of the scanning of the Vth correction and the signal writing and μ correction in two units which are adjacent to each other in the column direction.

Here, below, description will be given by separating all pixels 11 within one unit as groups for each connected scanning line WSL. In the modified example, all pixels 11G and all pixels 11W within one unit are set as one group and all pixels 11R and all pixels 11B within one unit are set as one group. So, below, all pixels 11G and all pixels 11W within a unit in which the scanning lines WSL (n) and WSL (n+1) are connected are set as the first group and all pixels 11R and all pixels 11B within the unit are set as the second group. In addition, all pixels 11G and all pixels 11W within a unit in which the scanning lines WSL (n+2) and WSL (n+3) are connected are set as the third group and all pixels 11R and all pixels 11B within the unit are set as the fourth group.

After performing the Vth correction with respect to all groups (the first and the second group) within one unit at the same period, the driving circuit 20 performs the signal writing for each group with respect to all groups (the first and the second group) within the unit in order. At this time, after performing the signal writing with respect to the first group of the pixels 11 which are arranged in the upper row within one pixel row, the driving circuit 20 performs the signal writing with respect to the second group of the pixels 11 which are arranged in the lower row within one pixel row.

After this, after performing the Vth correction with respect to all groups (the third and the fourth group) within the next unit at the same period, the driving circuit 20 performs the signal writing for each group with respect to all groups (the third and the fourth group) within the unit in order. At this time, after performing the signal writing with respect to the first group of the pixels 11 which are arranged in the upper row within one pixel row, the driving circuit 20 performs the signal writing with respect to the second group of the pixels 11 which are arranged in the lower row within one pixel row in the same way as described above.

At this time, after performing the Vth correction within one horizontal period (1H) with respect to one unit, the driving circuit 20 performs the signal writing within the next horizontal period (1H). That is, the driving circuit 20 continuously uses two horizontal periods (2H) with respect to one unit to perform the Vth correction and the signal writing.

In addition, when performing the signal writing for each group, the driving circuit 20 performs the signal writing at the same time with respect to all pixels 11 included in the group. Specifically, when the scanning line WSL (n) has been selected, the driving circuit 20 outputs the voltage V (n) described above with respect to each signal line DTL. That is, when the scanning line WSL (n) has been selected, the driving circuit 20 outputs Vsig (Vsig (n, m) and Vsig (n, m+2)) of the n-pixel row with respect to even-numbers of the signal lines DTL (DTL (m) and DTL (m+2)) and outputs the voltage Vsig (Vsig (n+1, m+1) and Vsig (n+1, m+3)) corresponding the n+1-pixel row with respect to odd-numbers of the signal lines DTL (m+1) and DTL (m+3) at the same time. In addition, when the scanning line WSL (n+1) has been selected, the driving circuit 20 outputs Vsig (Vsig (n+1, m) and Vsig (n+1, m+2)) of the n+1-pixel row with respect to even-numbers of the signal lines DTL (DTL (m) and DTL (m+2)) and outputs the voltage Vsig (Vsig (n, m+1) and Vsig (n, m+3)) corresponding the n-pixel row with respect to odd-numbers of the signal lines DTL (m+1) and DTL (m+3) at the same time.

As a result of doing so, in each pixel 11G of the same color, since the periods from the finish of the Vth correction to the start of the μ correction (a waiting time Δt1, as it is called) correspond, the waiting times Δt1 in a plurality of pixels 11R correspond for each pixel row. In the embodiment, the waiting time Δt2 of each pixel 11W is equal to the waiting time Δt1 of each pixel 11G. Therefore, since the waiting times Δt2 also correspond in each pixel 11W of the same color, the waiting times Δt2 in a plurality of pixels 11W correspond for each pixel row. In addition, since the waiting times Δt3 also correspond in each pixel 11R of the same color, the waiting times Δt3 in a plurality of pixels 11R correspond for each pixel row. In the embodiment, the waiting time Δt4 of each pixel 11B is equal to the waiting time Δt3 of each pixel 11R. Therefore, since the waiting times Δt4 also correspond in each pixel 11B of the same color, the waiting times Δt4 in a plurality of pixels 11B correspond for each pixel row. Here, the waiting times Δt1 and Δt2 of the pixels 11G and 11W and the waiting times Δt3 and Δt4 of the pixels 11R and 11B are different from each other and however, this slightly affects only the color reproductivity and dose not affect the color shading.

In addition, after performing the writing of the signal voltage into each pixel 11 in one unit with respect to pixels 11 (for example, pixels 11W and 11G) of one kind or a plurality of kinds of luminescent colors including the pixel 11 (for example, pixel 11W) of the luminescent color in which the distance between the single color coordinates and the mixed color coordinates is relatively the shortest, the driving circuit 20 performs the writing of the signal voltage with respect to the pixels 11 (for example, pixels 11R and 11B) of a plurality of kinds of luminescent colors in which the kinds of luminescent colors are different from these pixels 11. In so doing, in sequence of the signal writing within one unit, it is possible to perform the signal writing into the pixel 11 of the luminescent color in which the distance between the single color coordinates and the mixed color coordinates is relatively the shortest, first.

Effect

Next, description of the effects in the display device 1 according to the embodiments will be given. In the embodiment, each scanning line WSL used for selecting each pixel 11 is connected to a plurality of pixels 11 of the same luminescent color within one unit. In addition, each power line DSL used for supplying each pixel 11 with the driving current is connected to all pixels 11 within one unit. In so doing, as described above, after performing the Vth correction with respect to all groups at the same period within one unit, it is possible to perform the writing of the signal voltage with respect to all groups for each group within one unit. As a result, in each pixel 11 of the same luminescent color, since the waiting times from the finish of the Vth correction to the start of the μ correction correspond, the waiting times in the pixel 11 of the same luminescent color correspond for each line. Therefore, it is possible to decrease the occurrence of the luminance unevenness due to the Vth correction being bundle.

In addition, in the embodiment, the scanning line (the scanning line WSL (n)) of the highest row out of k's of the scanning lines WSL assigned for one unit is connected to the pixel 11 (hereinafter, referred as a "specific pixel 11") of one kind or a plurality of kinds of luminescent colors including the pixel 11 (here, pixel 11G) of the luminescent color in which the distance between the single color coordinates and the mixed color coordinates is relatively the shortest. In so doing, in sequence of the signal writing within one unit, the signal writing into the specific pixel 11 is performed first. In such a sequence of the signal writing, since the timing margin is not limited by the signal writing of the latter part when the signal writing into the specific pixel 11 is performed, even though the 1H period is considerably shorten, it is possible to take the adequate timing margin. Therefore, it is possible to decrease the occurrence of the luminance unevenness and the chromaticity shift due to transient when driving with high speed.

4. Common Modified Examples in Each Embodiment

Figure 20:
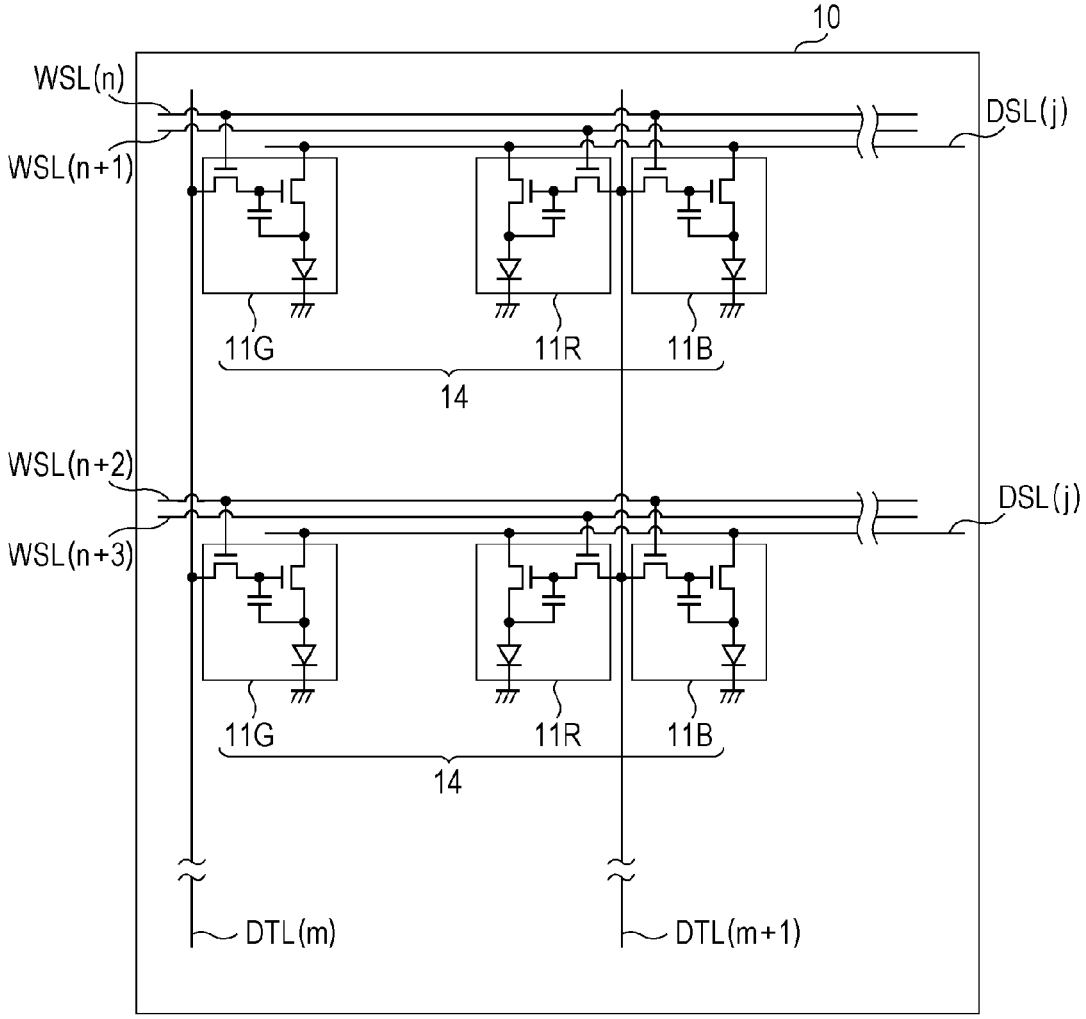
FIG. 20 is a view representing another modified example of a hard wiring configuration of a scanning line and a power line in FIG. 3 and FIG. 4.
Figure 21:
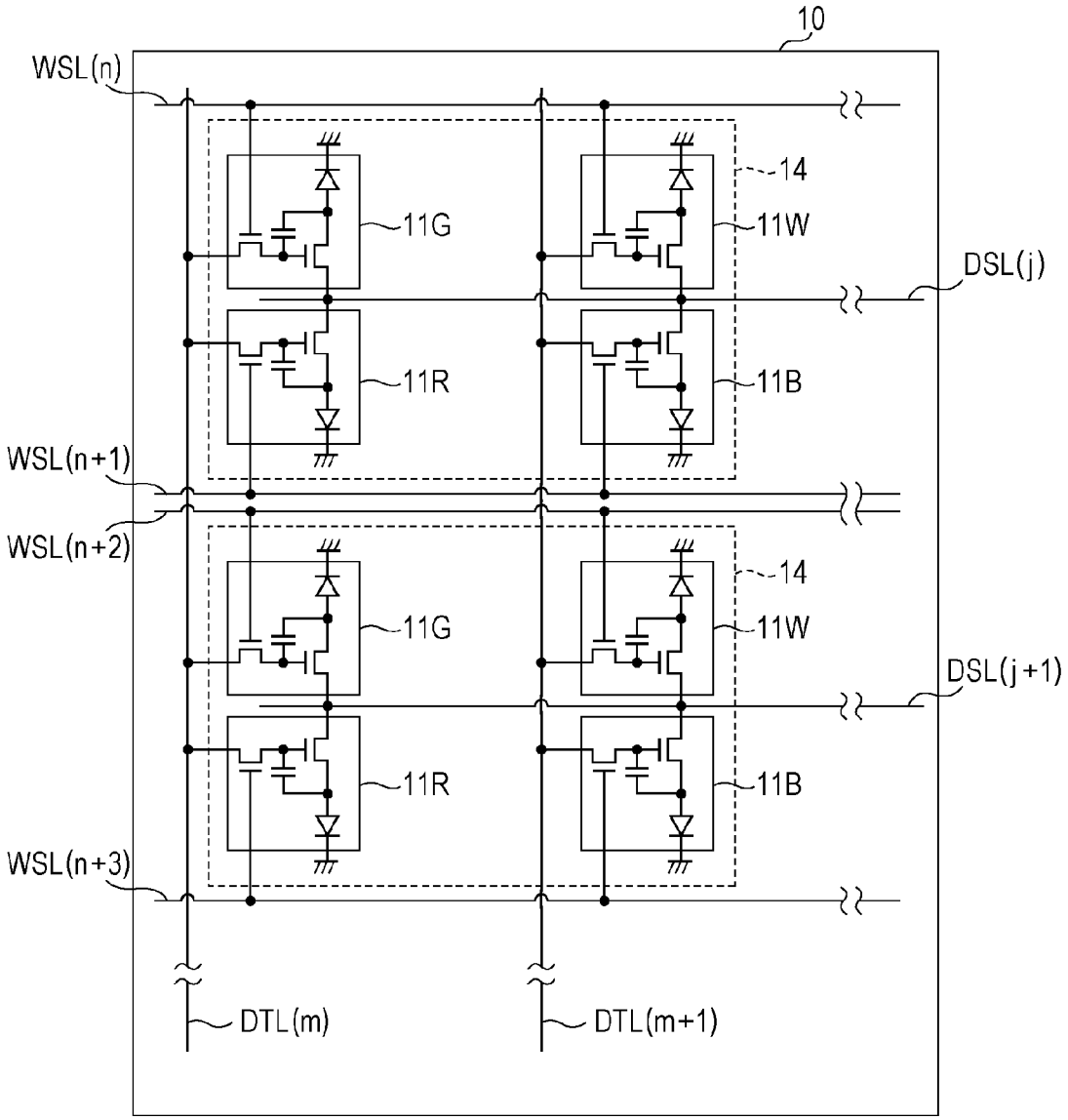
FIG. 21 is a view representing another modified example of a hard wiring configuration of a scanning line and a power line in FIG. 16 and FIG. 17.

In each embodiment described above, the scanning line WSL was provided with the branch and was connected to a plurality of the pixels 11 in which the subpixel rows are different from each other. However, as shown in FIG. 20 and FIG. 21, the scanning line WSL is not provided with the branch and in addition, may be connected to only a plurality of the pixels 11 in which the subpixels rows are equal to each other.

5. Application Example

Hereinafter, Application Examples of the display device 1 described in each embodiment described above and the modified examples thereof (the embodiments or the like) will be described. The display device 1 of the embodiments or the like can be applied to a display device of an electronic apparatus such as a television apparatus, a digital camera, a notebook personal computer, a portable terminal apparatus such as a portable telephone or a video camera, which displays a picture signal input externally or a picture signal generated in the interior as an image or a picture in every field.

APPLICATION EXAMPLE 1

Figure 22:
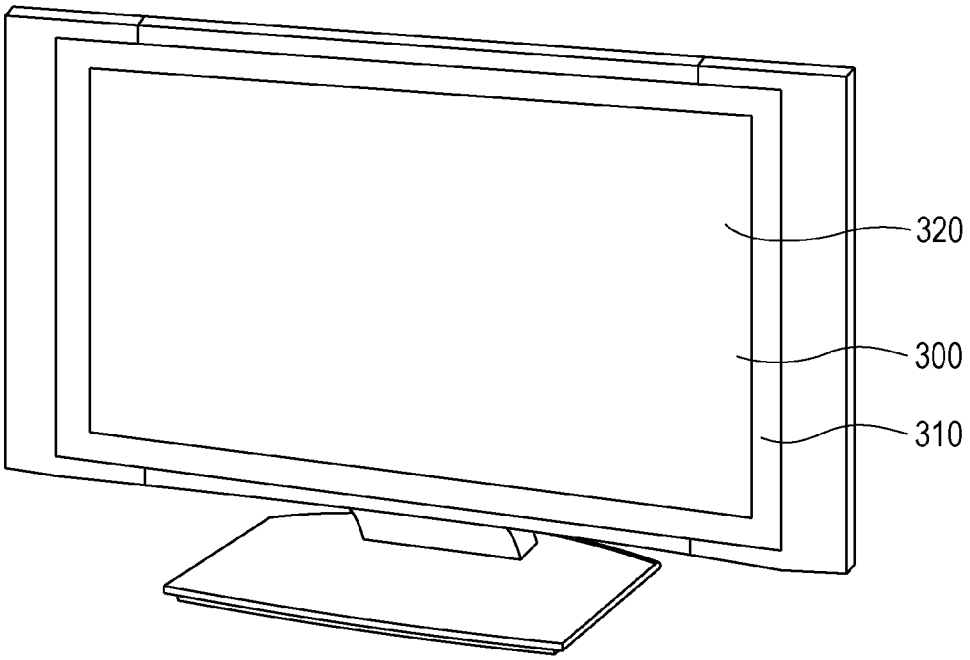
FIG. 22 is a perspective view representing the outside appearance in an Application Example 1 of a light emitting apparatus according to each embodiment described above.

FIG. 22 represents an appearance of a television apparatus in which the display device 1 in the embodiments or the like is applied. This television apparatus, for example, includes a picture display screen unit 300 having a front panel 310 and a filter glass 320 and the picture display screen unit 300 thereof is configured by the display device 1 in the embodiments or the like.

APPLICATION EXAMPLE 2

Figure 23A:
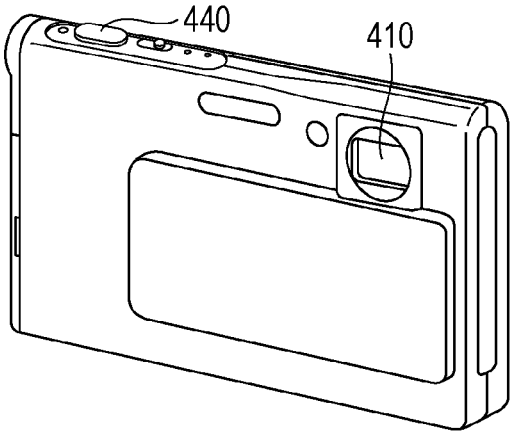
FIG. 23A is a perspective view representing the outside appearance viewed from the front in an Application Example 2 and FIG. 23B is a perspective view representing the outside appearance viewed from the other side.
Figure 23B:
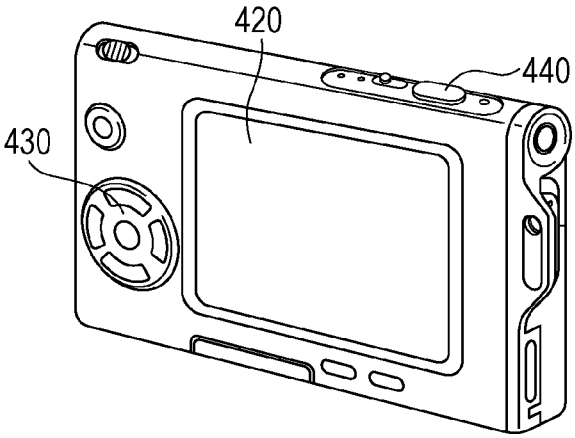

FIG. 23 represents an appearance of a digital camera in which the display device 1 in the embodiments or the like is applied. This digital camera, for example, includes a light emitting unit 410 for a flash, a display unit 420, a menu switch 430 and a shutter button 440, and the display unit 420 thereof is configured by the display device 1 in the embodiments or the like.

APPLICATION EXAMPLE 3

Figure 24:
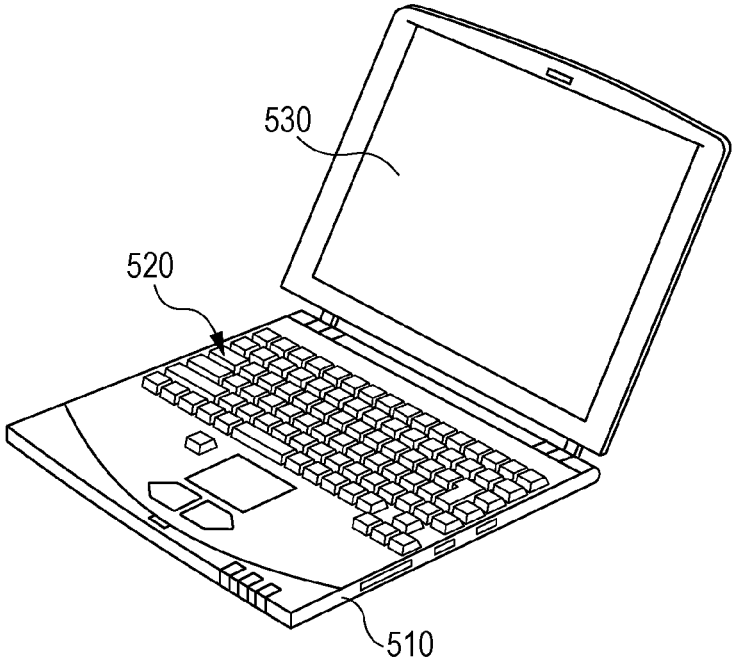
FIG. 24 is a perspective view representing the outside appearance in an Application Example 3.

FIG. 24 represents an appearance of a notebook personal computer in which the display device 1 in the embodiments or the like is applied. This notebook personal computer, for example, includes a main body 510, a keyboard 520 for an input operation of characters or the like and a display unit 530 for displaying an image and the display unit 530 thereof is configured by the display device 1 in the embodiments or the like.

APPLICATION EXAMPLE 4

Figure 25:
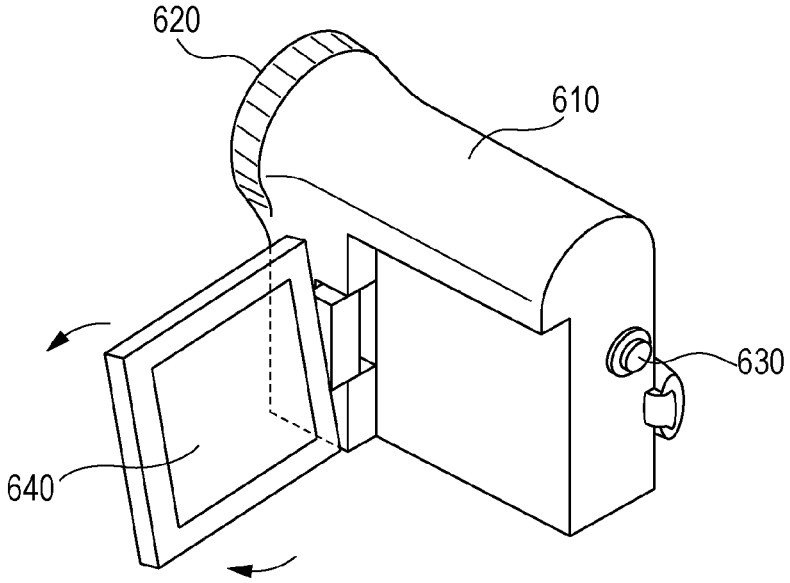
FIG. 25 is a perspective view representing the outside appearance in an Application Example 4.

FIG. 25 represents an appearance of a video camera in which the display device 1 in the embodiments or the like is applied. This video camera, for example, includes a main body unit 610, a lens 620 for taking a picture of the subject provided on the front-side of this main body unit 610, a start/stop switch 630 when taking a picture and a display unit 640 and the display unit 640 thereof is configured by the display device 1 in the embodiments or the like.

APPLICATION EXAMPLE 5

Figures 26A, 26B, 26C, 26D, 26E, 26F, 26G:
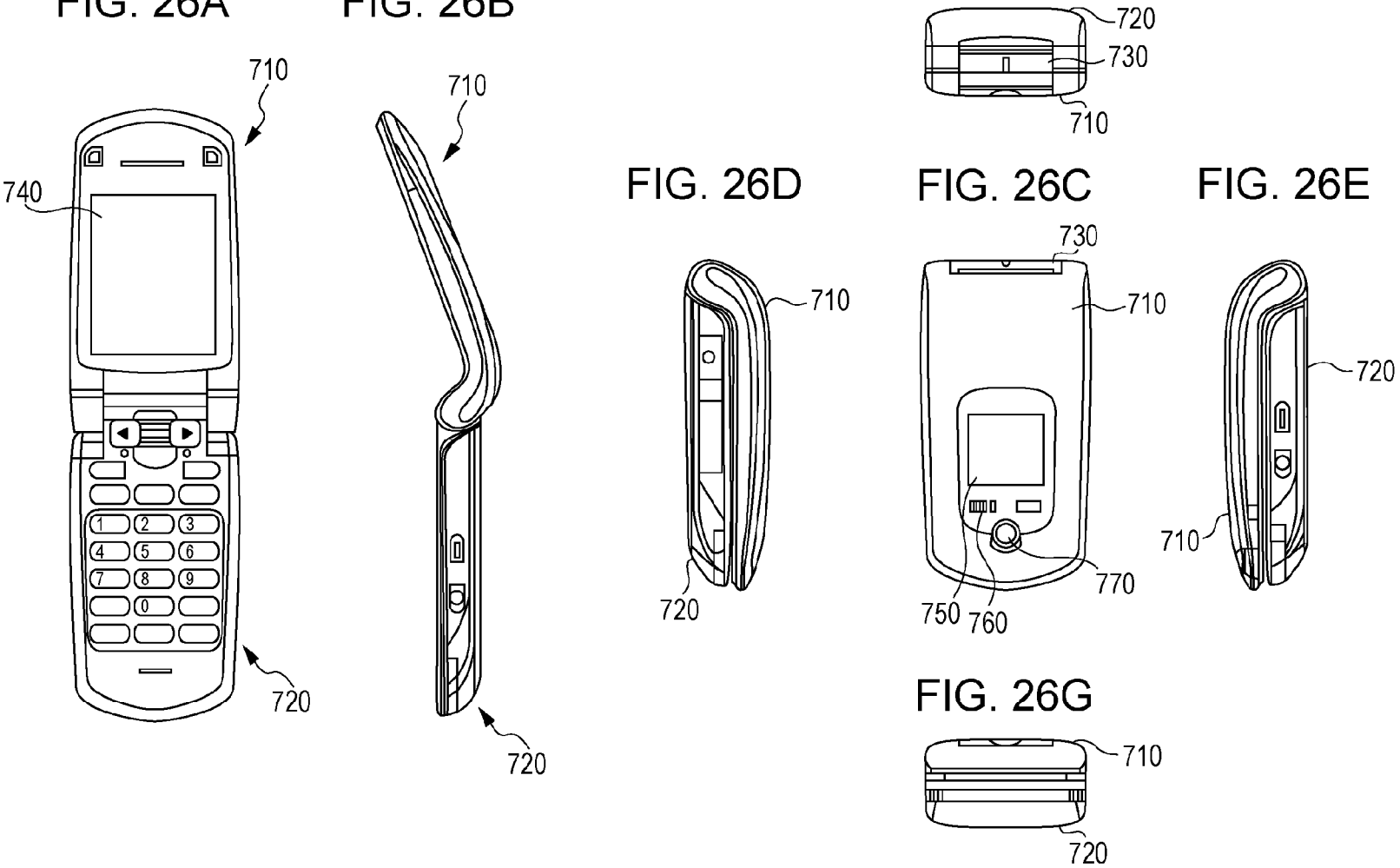
FIG. 26A is a front view of the state of being open in an Application Example 5.
FIG. 26B is a side view thereof.
FIG. 26C is a front view of the state of being closed.
FIG. 26D is a left-side view.
FIG. 26E is a right-side view.
FIG. 26F is a top view and FIG. 26G is a bottom view.

FIG. 26 represents an appearance of a portable telephone instrument in which the display device 1 in the embodiments or the like is applied. This portable telephone instrument, for example, is a portable telephone instrument in which an upper housing 710 and a lower housing 720 are linked using a linking unit (a hinge unit) 730 and includes a display 740, a sub-display 750, a picture light 760 and a camera 770. The display 740 and the sub-display 750 thereof are configured by the display device 1 in the embodiments or the like.

Above, the present technology has been described with reference to embodiments and Application Examples; however, the present technology is not limited to the embodiments or the like, and various modifications are possible.

For example, in the embodiments or the like, the configuration of the pixel circuit 12 for an active-matrix driving is not limited to each embodiment which has been described above and a capacity element or a transistor may be added as necessary. In this case, the necessary driving circuits other than the signal line driving circuit 23, the scanning line driving circuit 24, the power line driving circuit 25 and the like described above may be added according to the change of the pixel circuit 12.

In addition, in the embodiments or the like, the timing generating circuit 21 and the picture signal processing circuit 22 control a driving of the signal line driving circuit 23, the scanning line driving circuit 24 and the power line driving circuit 25, however, other circuits may control a driving thereof. In addition, the control of the signal line driving circuit 23, the scanning line driving circuit 24 and the power line driving circuit 25 may be performed using the hardware (circuit) or may be performed using the software (program).

In addition, in the embodiments or the like, description has been given as the source and the drain of the writing transistor Tr2 and the source and the drain of the driving transistor Tr1 being fixed, and needless to say, the opposite relationship of the source and the drain depending on the direction of the current flows is often reversed from the description described above. At this time, in the embodiments or the like, the source may be read as the drain as well as the drain may be read as the source.

In addition, in the embodiments or the like, description has been given as the writing transistor Tr2 and the driving transistor Tr1 being formed by a TFT of an n-channel MOS type, however, at least one of the writing transistor Tr2 and the driving transistor Tr1 may be formed by a TFT of a p-channel MOS type. Here, in a case where the driving transistor Tr1 is formed by a TFT of a p-channel MOS type, in the embodiments or the like, an anode of the organic EL element 13 becomes a cathode and a cathode of the organic EL element 13 becomes an anode. In addition, in the embodiments or the like, it is not typically necessary for the writing transistor Tr2 and the driving transistor Tr1 to be a TFT of an amorphous silicon type or a TFT of a micro silicon type and, for example, they may be a TFT of a low-temperature poly-silicon type or a TFT of an oxide semiconductor.

The present disclosure has been described according to the several embodiments and modification examples and the application example of an electronic apparatus, but the present disclosure is not limited to these embodiments and various modifications can be made.

For example, in each of the above-described embodiments, the display device includes the organic EL display elements, but the present disclosure is not limited thereto. Any display device may be used, as long as the display device includes current driving type display elements.

Embodiments of the present disclosure can be configured to include follows.

(1) A display device, comprising: a plurality of pixel circuits disposed in a matrix including rows and columns, the plurality of pixel circuits including a first pixel circuit and a second pixel circuit, the first pixel circuit being configured to emit light of a first color, the second pixel circuit being configured to emit light of a second color; wherein a given signal line provides a first image data signal and a second image data signal respectively to the first pixel circuit and the second pixel circuit, the first pixel circuit and the second pixel circuit being configured to respectively receive the first image data signal and the second image data signal from the given signal line within a horizontal scanning period, the first pixel circuit being configured to receive the first image data signal before the second pixel circuit receives the second image data signal within the horizontal scanning period, and wherein the first color is green.

(2) The display device according to (1), further comprising: a plurality of scanning lines including a first scanning line corresponding to the first pixel circuit and a second scanning line corresponding to the second pixel circuit; and a plurality of signal lines including the given signal line, the given signal line corresponding to both the first pixel circuit and the second pixel circuit, wherein the first scanning line and the second scanning line respectively provide first and second control signals for writing the first and second image data signals to the first and second pixel circuits, and the given signal line provides the first image data signal to the first pixel circuit and then provides the second image data signal to the second pixel circuit in response to the first and second control signals.

(3) The display device according to (1) or (2), wherein the first color is more susceptible to human misperception due to variations in image data signals than the second color.

(4) The display device according to any one of (1) to (3), wherein the first color is the most susceptible to human misperception due to variations in image data signals among three or more colors respectively emitted by the plurality of pixel circuits.

(5) The display device according to any one of (1) to (4), wherein the second color is red.

(6) The display device according to any one of (1) to (5), wherein the first pixel circuit and the second pixel circuit are resident in a given pixel row.

(7) The display device according to any one of (1) to (6), wherein the plurality of pixel circuits respectively include organic light emitting elements.

(8) An electronic apparatus comprising the display device according to any one of (1) to (7).

(9) A method of driving a display device including a plurality of pixel circuits disposed in a matrix including rows and columns, the plurality of pixel circuits including a first pixel circuit and a second pixel circuit, the first pixel circuit being configured to emit light of a first color, the second pixel circuit being configured to emit light of a second color, the method comprising: providing, through a given signal line, a first image data signal and a second image data signal respectively to the first pixel circuit and the second pixel circuit, the first pixel circuit and the second pixel circuit respectively receiving the first image data signal and the second image data signal from the given signal line within a horizontal scanning period, the first pixel circuit receiving the first image data signal before the second pixel circuit receives the second image data signal within the horizontal scanning period, wherein the first color is green.

(10) The method according to (9), wherein the first color is more susceptible to human misperception due to variations in image data signals than the second color.

(11) The method according to (9) or (10), wherein the first color is the most susceptible to human misperception due to variations in image data signals among three or more colors respectively emitted by the plurality of pixel circuits.

(12) The method according to any one of (9) or (11), wherein the second color is red.

(13) The method according to any one of (9) or (12), wherein the first pixel circuit and the second pixel circuit are resident in a given pixel row.

(14) The method according to any one of (9) or (13), wherein the plurality of pixel circuits respectively include organic light emitting elements.

(15) A display device, comprising: a plurality of pixel circuits disposed in a matrix including rows and columns, the plurality of pixel circuits including a first pixel circuit resident in a first pixel row and a second pixel circuit resident in a second pixel row, the first pixel circuit being configured to emit light of a first color, the second pixel circuit being configured to emit light of a second color; wherein the first pixel circuit and the second pixel circuit are configured to respectively receive a first image data signal and a second image data signal from a given signal line within a horizontal scanning period, the first pixel circuit being configured to receive the first image data signal before the second pixel circuit receives the second image data signal within the horizontal scanning period, and wherein the first color is green.

(16) The display device according to (15), further comprising: a plurality of scanning lines including a first scanning line corresponding to the first pixel row and a second scanning line corresponding to the second pixel row; and a plurality of signal lines including a given signal line corresponding to both the first pixel circuit and the second pixel circuit, wherein the first scanning line and the second scanning line respectively provide first and second control signals for writing the first and second image data signals to the first and second pixel circuits, and the given signal line provides the first image data signal to the first pixel circuit and then provides the second image data signal to the second pixel circuit in response to the first and second control signals.

(17) The display device according to (15) or (16), wherein the first color is more susceptible to human misperception due to variations in image data signals than the second color.

(18) The display device according to any one of (15) to (17), wherein the first color is the most susceptible to human misperception due to variations in image data signals among three or more colors respectively emitted by the plurality of pixel circuits.

(19) The display device according to any one of (15) to (18), wherein the second color is red.

(20) The display device according to any one of (15) to (19), wherein the plurality of pixel circuits respectively include organic light emitting elements.

(21) A display panel comprising: a plurality of pixels including three or more subpixels in which the kinds of luminescent colors are different from each other; a plurality of scanning lines which are assigned with k's for one unit when k's ($k \geq 2$) of pixel rows are set as one unit and are used for selecting each subpixel; and a plurality of power lines which are assigned with one line for one unit and are used for supplying each subpixel with a driving current, wherein each scanning line is connected to a plurality of subpixels of the same luminescent color within one unit, wherein each power line is connected to all subpixels within one unit, wherein when the coordinates in an u'v' chromaticity diagram of each luminescent color included in one pixel are set as single color coordinates and the coordinates in an u'v' chromaticity diagram of a plurality of mixed colors capable of being formed by using two arbitrary colors out of a plurality of luminescent colors included in one pixel are set as mixed color coordinates, the scanning line of the highest row out of k's of the scanning lines assigned for one unit is connected to the subpixels of one kind or a plurality of kinds of luminescent colors including the subpixels of the luminescent color in which the distance between the single color coordinates and the mixed color coordinates is relatively the shortest.

(22) The display panel according to (21), comprising, a plurality of signal lines which are assigned with a's ($2 \leq a <$ (the total number of the subpixels in one pixel)) for each pixel in each pixel row and are used for supplying each subpixel with a signal voltage according to a picture signal, wherein the first signal line out of a's of the signal lines which are assigned for each pixel in each pixel row is connected to the subpixels of two kinds of luminescent colors which are not shared with the scanning line in one pixel.

(23) The display panel according to (22), wherein the number of the kinds of luminescent colors included in one pixel is three, and wherein the first signal line is connected to the subpixels of two kinds of luminescent colors other than the subpixels of the luminescent color in which the distance between the single color coordinates and the mixed color coordinates is relatively the shortest.

(24) The display panel according to (22), wherein the number of the kinds of luminescent colors included in one pixel is four, wherein the second signal line out of a's of the signal lines which are assigned for each pixel in each pixel row is connected to the subpixels of two kinds of luminescent colors which are not shared with the scanning line in one pixel as well as is connected to the subpixels of two kinds of luminescent colors including the subpixels of the luminescent color in which the distance between the single color coordinates and the mixed color coordinates is relatively the shortest, and wherein the first signal line is connected to the subpixels of two kinds of luminescent colors which are not connected to the second signal line.

(25) The display panel according to (24), wherein the first signal line is connected to the subpixels of two kinds of luminescent colors including the subpixels of the luminescent color in which the distance between the single color coordinates and the mixed color coordinates is relatively the second shortest.

(26) A display device comprising: a display panel; and a driving circuit for driving the display panel, wherein the display panel includes a plurality of pixels including three or more subpixels in which the kinds of luminescent colors are different from each other, a plurality of scanning lines which are assigned with k's for one unit when k's (k≥2) of pixel rows are set as one unit and are used for selecting each subpixel and a plurality of power lines which is assigned with one line for one unit and are used for supplying each subpixel with a driving current, wherein each scanning line is connected to a plurality of subpixels of the same luminescent color within one unit, wherein each power line is connected to all subpixels within one unit, and wherein when the coordinates in an u'v' chromaticity diagram of each luminescent color included in one pixel are set as single color coordinates and the coordinates in an u'v' chromaticity diagram of a plurality of kinds of mixed colors capable of being formed by using two arbitrary colors out of a plurality of luminescent colors included in one pixel are set as mixed color coordinates, the first scanning line of the highest row out of k's of the scanning lines assigned for one unit is connected to the subpixels of one kind or a plurality of kinds of luminescent colors including the subpixels of the luminescent color in which the distance between the single color coordinates and the mixed color coordinates is relatively the shortest.

(27) The display device according to (26), wherein each subpixel includes a light emitting element, a driving transistor for driving the light emitting element and a writing transistor for writing a signal voltage corresponding to a picture signal into a gate of the driving transistor, wherein the driving circuit collectively performs the Vth correction in which the voltage between a gate and a source of the driving transistor is set close to the threshold voltage of the driving transistor and the writing of the signal voltage for each unit, and wherein after performing the writing of the signal voltage into each subpixel in one unit with respect to all subpixels connected to the first scanning line, the driving circuit performs the writing of the signal voltage with respect to a plurality of subpixels connected to the other scanning lines.

(28) An electronic apparatus comprising: a display device; wherein the display device includes a display panel and a driving circuit for driving the display panel, wherein the display panel includes a plurality of pixels including three or more subpixels in which the kinds of luminescent colors are different from each other, a plurality of scanning lines which are assigned with k's for one unit when k's (k≥2) of pixel rows are set as one unit and are used for selecting each subpixel and a plurality of power lines which are assigned with one line for one unit and are used for supplying each subpixel with a driving current, wherein each scanning line is connected to a plurality of subpixels of the same luminescent color within one unit, wherein each power line is connected to all subpixels within one unit, and wherein when the coordinates in an u'v' chromaticity diagram of each luminescent color included in one pixel are set as single color coordinates and the coordinates in an u'v' chromaticity diagram of a plurality of kinds of mixed colors capable of being formed by using two arbitrary colors out of a plurality of luminescent colors included in one pixel are set as mixed color coordinates, the scanning line of the highest row out of k's of the scanning lines assigned for one unit is connected to the subpixels of one kind or a plurality of kinds of luminescent colors including the subpixels of the luminescent color in which the distance between the single color coordinates and the mixed color coordinates is relatively the shortest.

(29) A display device comprising: a display panel; and a driving circuit for driving the display panel, wherein the display panel includes a plurality of pixels including a plurality of subpixels in which the kinds of luminescent colors are different from each other, wherein each subpixel includes a light emitting element, a driving transistor for driving the light emitting element and a writing transistor for writing a signal voltage corresponding to a picture signal into a gate of the driving transistor, wherein the driving circuit collectively performs the Vth correction in which the voltage between a gate and a source of the driving transistor is set close to the threshold voltage of the driving transistor and the writing of the signal voltage for each unit when k's (k≥2) of pixel rows are set as one unit, and wherein when the coordinates in an u'v' chromaticity diagram of each luminescent color included in one pixel are set as single color coordinates and the coordinates in an u'v' chromaticity diagram of a plurality of kinds of mixed colors capable of being formed by using two arbitrary colors out of a plurality of luminescent colors included in one pixel are set as mixed colors coordinates, after performing the writing of the signal voltage into each subpixel in one unit with respect to the subpixels of one kind or a plurality of kinds of luminescent colors including the subpixels of the luminescent color in which the distance between the single color coordinates and the mixed color coordinates is relatively the shortest, the driving circuit performs the writing of the signal voltage with respect to the subpixels of one kind or a plurality of kinds of luminescent colors in which the kinds of luminescent colors are different from the subpixels thereof.

(30) The display device according to (29), wherein the number of the kinds of luminescent colors included in one pixel is three, and wherein, after performing the writing of the signal voltage into each subpixel in one unit with respect to the subpixels of one kind or two kinds of luminescent colors including the subpixels of the luminescent color in which the distance between the single color coordinates and the mixed color coordinates is relatively the shortest, the driving circuit performs the writing of the signal voltage with respect to the subpixels of the kinds of luminescent colors in which the kinds of luminescent colors are different from the subpixels thereof.

(31) The display device according to (29), wherein the number of the kinds of luminescent colors included in one pixel is four, and wherein, after performing the writing of the signal voltage into each subpixel in one unit with respect to the subpixels of one kind or two kinds of the luminescent colors including the subpixels of the luminescent color in which the distance between the single color coordinates and the mixed color coordinates is relatively the shortest, the driving circuit performs the writing of the signal voltage with respect to the subpixels of the kinds of luminescent colors in which the kinds of luminescent colors are different from the subpixels thereof.

(32) An electronic apparatus comprising: a display device; wherein the display device includes a display panel and a driving circuit for driving the display panel, wherein the display panel includes a display panel and a driving circuit for driving the display panel, wherein the display panel includes a plurality of pixels including a plurality of subpixels in which the kinds of luminescent colors are different from each other, wherein each subpixel includes a light emitting element, a driving transistor for driving the light emitting element and a writing transistor for writing a signal voltage corresponding to a picture signal into a gate of the driving transistor, wherein the driving circuit collectively performs the Vth correction in which the voltage between a gate and a source of the driving transistor is set close to the threshold voltage of the driving transistor and the writing of the signal voltage for each unit when k's ($k \geq 2$) of pixel rows are set as one unit, and wherein when the coordinates in an u'v' chromaticity diagram of each luminescent color included in one pixel are set as single color coordinates and the coordinates in an u'v' chromaticity diagram of a plurality of kinds of mixed colors capable of being formed by using two arbitrary colors out of a plurality of luminescent colors included in one pixel are set as mixed colors coordinates, after performing the writing of the signal voltage into each subpixel in one unit with respect to the subpixels of one kind or a plurality of kinds of luminescent colors including the subpixels of the luminescent color in which the distance between the single color coordinates and the mixed color coordinates is relatively the shortest, the driving circuit performs the writing of a signal voltage with respect to the subpixels of one kind or a plurality of kinds of luminescent colors in which the kinds of luminescent colors are different from the subpixels thereof.

(33) A display panel comprising; a plurality of pixels including three or more subpixels in which the kinds of luminescent colors are different from each other; a plurality of signal lines which are assigned with a's ($2 \leq a <$(the total number of the subpixels in one pixel)) for each pixel in each pixel row and are used for supplying each subpixel with the signal voltage according to a picture signal; and a plurality of scanning lines which are assigned with b's ($2 \leq b \leq$(the total number of the subpixels in one pixel)) for each pixel row as well as are connected to a plurality of subpixels of the same luminescent color and are used for selecting each subpixel, wherein the first signal line out of a's of the signal lines which are assigned for each pixel is connected to the subpixels of two kinds of luminescent colors which are not shared with the scanning line in one pixel.

(34) The display panel according to (33), wherein the number of the kinds of luminescent colors included in one pixel is three, and wherein when the coordinates in an u'v' chromaticity diagram of each luminescent color included in one pixel are set as single color coordinates and the coordinates in an u'v' chromaticity diagram of a plurality of kinds of mixed colors capable of being formed by using two arbitrary colors out of a plurality of luminescent colors included in one pixel are set as mixed color coordinates, the first signal line is connected to the subpixels of two kinds of luminescent colors other than the subpixels of the luminescent color in which the distance between the single color coordinates and the mixed color coordinates is relatively the shortest.

(35) The display panel according to (33), wherein the number of the kinds of luminescent colors included in one pixel is four, and wherein when the coordinates in an u'v' chromaticity diagram of each luminescent color included in one pixel are set as single color coordinates and the coordinates in an u'v' chromaticity diagram of a plurality of kinds of mixed colors capable of being formed by using two arbitrary colors out of a plurality of luminescent colors included in one pixel are set as mixed color coordinates, the second signal line out of a's of the signal lines which are assigned for each pixel is connected to the subpixels of two kinds of luminescent colors which are not shared with the scanning line in one pixel as well as is connected to the subpixels of two kinds of luminescent colors including the subpixels of the luminescent color in which the distance between the single color coordinates and the mixed color coordinates is relatively the shortest, and wherein the first signal line is connected to the subpixels of two kinds of luminescent colors which are not connected to the second signal line.

(36) The display panel according to (35), wherein the first signal line is connected to the subpixels of two kinds of luminescent colors including the subpixels of the luminescent color in which the distance between the single color coordinates and the mixed color coordinates is relatively the second shortest.

(37) A display device comprising; a display panel; and a driving circuit for driving the display panel, wherein the display panel includes a plurality of pixels including three or more subpixels in which the kinds of luminescent colors are different from each other, a plurality of signal lines which are assigned with a's ($2 \leq a <$(the total number of the subpixels in one pixel)) for each pixel in each pixel row and are used for supplying each subpixel with the signal voltage according to a picture signal and a plurality of scanning lines which are assigned with b's ($2 \leq b \leq$(the total number of the subpixels in one pixel)) for each pixel row as well as are connected to a plurality of subpixels of the same luminescent color and are used for selecting each subpixel, and wherein the first signal line out of a's of the signal lines which are assigned for each pixel is connected to the subpixels of two kinds of luminescent colors which are not shared with the scanning line in one pixel.

(38) An electronic apparatus comprising; a display device, wherein the display device includes a display panel and a driving circuit for driving the display panel, and wherein the display panel includes a plurality of pixels including three or more subpixels in which the kinds of luminescent colors are different from each other, a plurality of signal lines which are assigned with a's ($2 \leq a <$(the total number of the subpixels in one pixel)) for each pixel in each pixel row and are used for supplying each subpixel with the signal voltage according to a picture signal and a plurality of scanning lines which are assigned with b's ($2 \leq b \leq$(the total number of the subpixels in one pixel)) for each pixel row as well as are connected to a plurality of subpixels of the same luminescent color and are used for selecting each subpixel, and wherein the first signal line out of a's of the signal lines which are assigned for each pixel is connected to the subpixels of two kinds of luminescent colors which are not shared with the scanning line in one pixel.

The present technology contains subject matter related to that disclosed in Japanese Priority Patent Application JP 2012-174278 filed in the Japan Patent Office on Aug. 6, 2012, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display device, comprising:

a plurality of pixel circuits disposed in a matrix including rows and columns, the plurality of pixel circuits including a first pixel circuit and a second pixel circuit adjacent to one another in the matrix, the first pixel circuit being configured to emit single-color light of a first color, the second pixel circuit being configured to emit single-color light of a second color;

wherein a threshold voltage correction is performed for the first pixel circuit and the second pixel circuit within a first horizontal scanning period, wherein a given signal line provides a first image data signal and a second image data signal respectively to the first pixel circuit and the second pixel circuit, the first pixel circuit and the second pixel circuit being configured to respectively receive the first image data signal and the second image data signal from the given signal line within a second horizontal scanning period after the first horizontal scanning period, the first pixel circuit being configured to receive the first image data signal before the second pixel circuit receives the second image data signal within the second horizontal scanning period, and wherein the first color is green.

2. The display device according to claim 1, further comprising:

a plurality of scanning lines including a first scanning line corresponding to the first pixel circuit and a second scanning line corresponding to the second pixel circuit; and a plurality of signal lines including the given signal line, the given signal line corresponding to both the first pixel circuit and the second pixel circuit, wherein the first scanning line and the second scanning line respectively provide first and second control signals for writing the first and second image data signals to the first and second pixel circuits, and the given signal line provides the first image data signal to the first pixel circuit and then provides the second image data signal to the second pixel circuit in response to the first and second control signals.

3. The display device according to claim 1, wherein the first color is more susceptible to general human misperception due to variations in image data signals than the second color.

4. The display device according to claim 1, wherein the first color is the most susceptible to general human misperception due to variations in image data signals among three or more colors respectively emitted by the plurality of pixel circuits.

5. The display device according to claim 1, wherein the second color is red.

6. The display device according to claim 1, wherein the first pixel circuit and the second pixel circuit are resident in a given pixel row.

7. The display device according to claim 1, wherein the plurality of pixel circuits respectively include organic light emitting elements.

8. An electronic apparatus comprising the display device according to claim 1.

9. A method of driving a display device including a plurality of pixel circuits disposed in a matrix including rows and columns, the plurality of pixel circuits including a first pixel circuit and a second pixel circuit adjacent to one another in the matrix, the first pixel circuit being configured to emit single-color light of a first color, the second pixel circuit being configured to emit single-color light of a second color, the method comprising:

performing a threshold voltage correction for the first pixel circuit and the second pixel circuit within a first horizontal scanning period; and providing, through a given signal line, a first image data signal and a second image data signal respectively to the first pixel circuit and the second pixel circuit, the first pixel circuit and the second pixel circuit respectively receiving the first image data signal and the second image data signal from the given signal line within a second horizontal scanning period after the first horizontal scanning period, the first pixel circuit receiving the first image data signal before the second pixel circuit receives the second image data signal within the second horizontal scanning period, wherein the first color is green.

10. The method according to claim 9, wherein the first color is more susceptible to general human misperception due to variations in image data signals than the second color.

11. The method according to claim 9, wherein the first color is the most susceptible to general human misperception due to variations in image data signals among three or more colors respectively emitted by the plurality of pixel circuits.

12. The method according to claim 9, wherein the second color is red.

13. The method according to claim 9, wherein the first pixel circuit and the second pixel circuit are resident in a given pixel row.

14. The method according to claim 9, wherein the plurality of pixel circuits respectively include organic light emitting elements.

15. A display device, comprising:

a plurality of pixel circuits disposed in a matrix including rows and columns, the plurality of pixel circuits including a first pixel circuit resident in a first pixel row and a second pixel circuit resident in a second pixel row adjacent to the first pixel row in the matrix, the first pixel circuit being configured to emit single-color light of a first color, the second pixel circuit being configured to emit single-color light of a second color;

wherein a threshold voltage correction is performed for the first pixel circuit and the second pixel circuit within a first horizontal scanning period, wherein the first pixel circuit and the second pixel circuit are configured to respectively receive a first image data signal and a second image data signal from a given signal line within a second horizontal scanning period after the first horizontal scanning period, the first pixel circuit being configured to receive the first image data signal before the second pixel circuit receives the second image data signal within the second horizontal scanning period, and wherein the first color is green.

16. The display device according to claim 15, further comprising:

a plurality of scanning lines including a first scanning line corresponding to the first pixel row and a second scanning line corresponding to the second pixel row; and a plurality of signal lines including the given signal line corresponding to both the first pixel circuit and the second pixel circuit, wherein the first scanning line and the second scanning line respectively provide first and second control signals for writing the first and second image data signals to the first and second pixel circuits, and the given signal line provides the first image data signal to the first pixel circuit and then provides the second image data signal to the second pixel circuit in response to the first and second control signals.

17. The display device according to claim 15, wherein the first color is more susceptible to general human misperception due to variations in image data signals than the second color.

18. The display device according to claim 15, wherein the first color is the most susceptible to general human misperception due to variations in image data signals among three or more colors respectively emitted by the plurality of pixel circuits.

19. The display device according to claim 15, wherein the second color is red.

20. The display device according to claim 15, wherein the plurality of pixel circuits respectively include organic light emitting elements.

* * * * *